US007299993B2

(12) United States Patent
Tsukamoto et al.

(10) Patent No.: US 7,299,993 B2
(45) Date of Patent: Nov. 27, 2007

(54) APPARATUS FOR DETECTING A FAILURE OF A THERMOSTAT FOR AN ENGINE

(75) Inventors: Toshinori Tsukamoto, Wako (JP); Eisaku Gosyo, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 293 days.

(21) Appl. No.: 10/858,645

(22) Filed: Jun. 1, 2004

(65) Prior Publication Data

US 2004/0262411 A1 Dec. 30, 2004

(30) Foreign Application Priority Data

May 30, 2003 (JP) ..... 2003-154031

(51) Int. Cl.
*F01P 7/02* (2006.01)

(52) U.S. Cl. ..... 236/34; 123/41.02; 123/41.1

(58) Field of Classification Search ..... 236/34, 236/34.5; 123/41.02, 41.08, 41.09, 41.1; 165/209; 73/119
See application file for complete search history.

(56) References Cited

U.S. PATENT DOCUMENTS 4,865,249 A * 9/1989 Sugano et al. ..... 236/92 C
6,161,767 A * 12/2000 Yeo ..... 236/34.5
6,240,774 B1 * 6/2001 Niki et al. ..... 73/118.1
6,386,022 B1 * 5/2002 Oka et al. ..... 73/118.1
6,481,387 B1 * 11/2002 Sano ..... 123/41.1
6,532,808 B1 * 3/2003 Matsumoto et al. ..... 73/119 R
6,694,246 B2 * 2/2004 Masuda et al. ..... 123/41.1
2002/0088274 A1 * 7/2002 Oka et al. ..... 73/118.1

* cited by examiner

*Primary Examiner*—Marc Norman
(74) *Attorney, Agent, or Firm*—Lahive & Cockfield, LLP; Anthony A. Laurentano, Esq.

(57) ABSTRACT

An apparatus for detecting a failure of a thermostat provided between an engine and a radiator is provided. The thermostat regulates circulation of cooling water between the engine and the radiator. The apparatus comprises a radiator water temperature sensor disposed on the radiator side relative to the thermostat and a controller. The controller performs a process for detecting a failure of the thermostat based on the output of the radiator water temperature sensor when the engine has reached a desired warm condition. In one example, it is determined whether the engine has reached the desired warm condition based on the output of the engine water temperature sensor that is provided in the engine side relative to the thermostat. In another example, it is determined whether the engine had reached the desired warm condition according to whether a vehicle-related process is activated. In yet another example, it is determined whether the engine has reached the desired warm condition based on an estimated value for the engine water temperature.

3 Claims, 23 Drawing Sheets

| TR_init | Start flag for vehicle-related process that is used as a trigger |
|---|---|
| ~5℃ | F_ClosedLoop |
| 5~25℃ | F_Purge |
| 25℃~ | F_EGR |

Figure 11

| Initial water temperature (TR_init／TW_init) | ～0℃ | 0～20℃ | 20～50℃ |
|---|---|---|---|
| Level appropriate to the failure detection process | 1 | 2 | 3 |
| Engine water temperature appropriate to the failure detection process | 30℃≦TW <50℃ | 50℃≦TW <70℃ | 70℃≦TW <100℃ |

APPARATUS FOR DETECTING A FAILURE OF A THERMOSTAT FOR AN ENGINE

BACKGROUND OF THE INVENTION

The present invention relates to an apparatus for detecting a failure of a thermostat that adjusts temperature of cooling water of an internal combustion engine.

A radiator mounted on a vehicle supplies water for cooling an internal combustion engine (hereinafter referred to as an engine). The engine and the radiator are connected via a passage, in which a thermostat is disposed to open and close the passage. The thermostat is a valve that is driven in accordance with temperature of the cooling water. The thermostat opens when the temperature of the cooling water is higher than a predetermined value, so that the cooling water circulates between the radiator and the engine. This predetermined value is hereinafter referred to as a thermostat opening temperature.

A failure that the thermostat does not close may occur. Such a failure is hereinafter referred to as a close failure. If such a close failure occurs during a cold start of the engine, an increase in the temperature of the cooling water (referred to as engine water temperature, hereinafter) may be suppressed, which may cause an emission of undesired substances such as HC.

Various schemes for detecting such a close failure of a thermostat are proposed. According to one method described in, for example, Japanese Patent Application Unexamined Publication (Kokai) No.H10-176534, a first water temperature sensor is provided on the engine side relative to the thermostat and a second water temperature sensor is provided on the radiator side relative to the thermostat. A failure of the thermostat is detected based on a difference between an output of the first water temperature sensor and an output of the second water temperature sensor. The failure detection process is carried out if the engine water temperature is lower than the thermostat opening temperature when predetermined time elapses after start of the engine.

According to another method disclosed in, for example, Japanese Patent Application Unexamined Publication (Kokai) No.2000-104549, the engine water temperature is estimated. A failure of the thermostat is detected based on a difference between the estimated engine water temperature and an actual engine water temperature detected by a sensor. The estimation of the engine water temperature is performed based on operating conditions of the engine. The failure detection process for the thermostat is carried out if the amount of heat generation of the engine is greater than a predetermined value when predetermined time has elapsed after start of the engine.

According to the above conventional method using the two sensors, a failure of the thermostat cannot be detected if a failure occurs in either of the two sensors. According to the method for estimating the engine water temperature, the failure detection may be influenced by various disturbances since such estimation uses operating conditions of the engine. In order to achieve robustness against disturbances, the operating conditions under which the failure detection process can be performed need to be limited.

In order to accurately detect a failure of the thermostat, it is preferable that the failure detection process is performed when the engine is in a predetermined warm condition. Such a warm condition preferably meets two requirements: (1) where the engine water temperature is lower than the thermostat opening temperature, and (2) where some amount of heat is generated from the engine.

The requirement (1) indicates a condition where the thermostat is closed if the thermostat is normal. If the failure detection process is performed when the requirement (1) is met, a close failure of the thermostat is surely detected.

When the engine is cold, the temperature of the cooling water is low regardless of whether the thermostat is open or closed. Under such a condition, a close failure of the thermostat may not be accurately detected. If the failure detection process is performed when the requirement (2) is met, a close failure of the thermostat is surely detected.

Conventionally, an elapsed time since the engine started is used for determining whether the engine has reached a desired warm condition. When a predetermined time has elapsed after the engine started, the failure detection process is performed. However, the elapsed time until the engine reaches the desired warm condition changes depending on various parameters such as engine operating conditions, atmospheric temperature and so on. If the engine has not reached the desired warm condition when the predetermined time has elapsed, the failure detection cannot be appropriately performed. If the engine has reached the desired warm condition before the predetermined time elapses, the failure detection is delayed until the predetermined time has elapsed.

Thus, according to the conventional methods, timing at which the failure detection process for the thermostat is performed is not appropriately determined, which leads to a reduction in the frequency of performing the failure detection process.

It is an object of the present invention to provide a thermostat failure detection apparatus that can increase the frequency of performing the thermostat failure detection by identifying an appropriate timing at which the engine reaches a desired warm condition appropriate to the thermostat failure detection. The thermostat failure detection process according to the present invention has robustness against various disturbances.

SUMMARY OF THE INVENTION

According to one aspect of the present invention, an apparatus for detecting a failure of a thermostat is provided. The thermostat is provided between an engine and a radiator to regulate circulation of cooling water between the engine and the radiator. The apparatus comprises a first temperature sensor (a radiator water temperature sensor) disposed on the radiator side relative to the thermostat. The apparatus also comprises a controller. If the engine has reached a desired warm condition appropriate to the thermostat failure detection process, the controller performs a process for detecting a failure of the thermostat. The process detects a failure based on the amount of change in a temperature detected by the first temperature sensor. According to the invention, a failure of the thermostat can be detected using one temperature sensor. Such a temperature sensor is provided on the radiator side, influence of disturbances on the failure detection process can be reduced.

According to one embodiment of the present invention, the apparatus further comprises a second temperature sensor (an engine water temperature sensor) provided on the engine side relative to the thermostat. It is determined that the engine has reached the desired warm condition if a temperature detected by the second temperature sensor reaches a first predetermined value. According to another embodiment of the present invention, it is determined that the engine has reached the desired warm condition if the amount of change in the temperature detected by the second temperature sensor exceeds a second predetermined value before the temperature detected by the second temperature sensor reaches the first predetermined value. According to the invention, a warm condition appropriate to the thermostat failure detection process can be easily identified from the output of the engine water temperature sensor.

According to another embodiment of the present invention, it is determined that the engine has reached the desired warm condition if a vehicle-related process is activated. Such a vehicle-related process is configured to be performed when the engine has reached the desired warm condition. According to the invention, a warm condition appropriate to the thermostat failure detection process can be easily identified in response to activation of a vehicle-related process. An engine water temperature sensor is not required. Thus, the thermostat failure detection process can be activated at an appropriate timing. According to another embodiment of the present invention, a vehicle-related process which serves as a trigger for activating the thermostat failure detection process is selected based on a temperature detected by the radiator water temperature sensor when the engine started.

According to another embodiment of the present invention, the controller is further configured to determine a level of the warm condition of the engine. It is determined whether the engine has reached the desired warm condition based on the determined level. According to the invention, a level of the warm condition is used to easily determine whether the engine has reached the desired warm condition. According to one embodiment of the present invention, a level of the warm condition which serves as a trigger for activating the thermostat failure detection process is determined based on a temperature detected by the radiator water temperature sensor when the engine started.

According to yet another embodiment of the present invention, the controller is further configured to estimate a temperature of the cooling water based on a heat amount generated from the engine. It is determined that the engine has reached the desired warm condition if the estimated temperature reaches a predetermined value. According to the invention, it is not required to provide an engine water temperature sensor. The desired warm condition can be identified by monitoring the estimated temperature.

According to yet another embodiment of the present invention, the controller is further configured to estimate a first temperature of the cooling water when a cooling loss is minimum and estimate a second temperature of the cooling water when a cooling loss is maximum. It is determined that the engine has reached the desired warm condition if the amount of change in the second temperature is greater than a predetermined value when the first temperature has reached a temperature that causes the thermostat to open. According to the invention, a condition in which the engine water temperature is lower than the thermostat opening temperature can be identified based on the first temperature. A condition in which some amount of heat is generated from the engine can be identified based on the second temperature. Thus, the desired warm condition can be identified based on the first and second water temperatures.

BRIEF DESCRIPTION OF THE DRAWINGS

FIG. 11 shows a table for storing a warm condition appropriate to a thermostat failure detection process in accordance with a third embodiment of the present invention.

DESCRIPTION OF THE PREFERRED EMBODIMENTS

Figure 1:
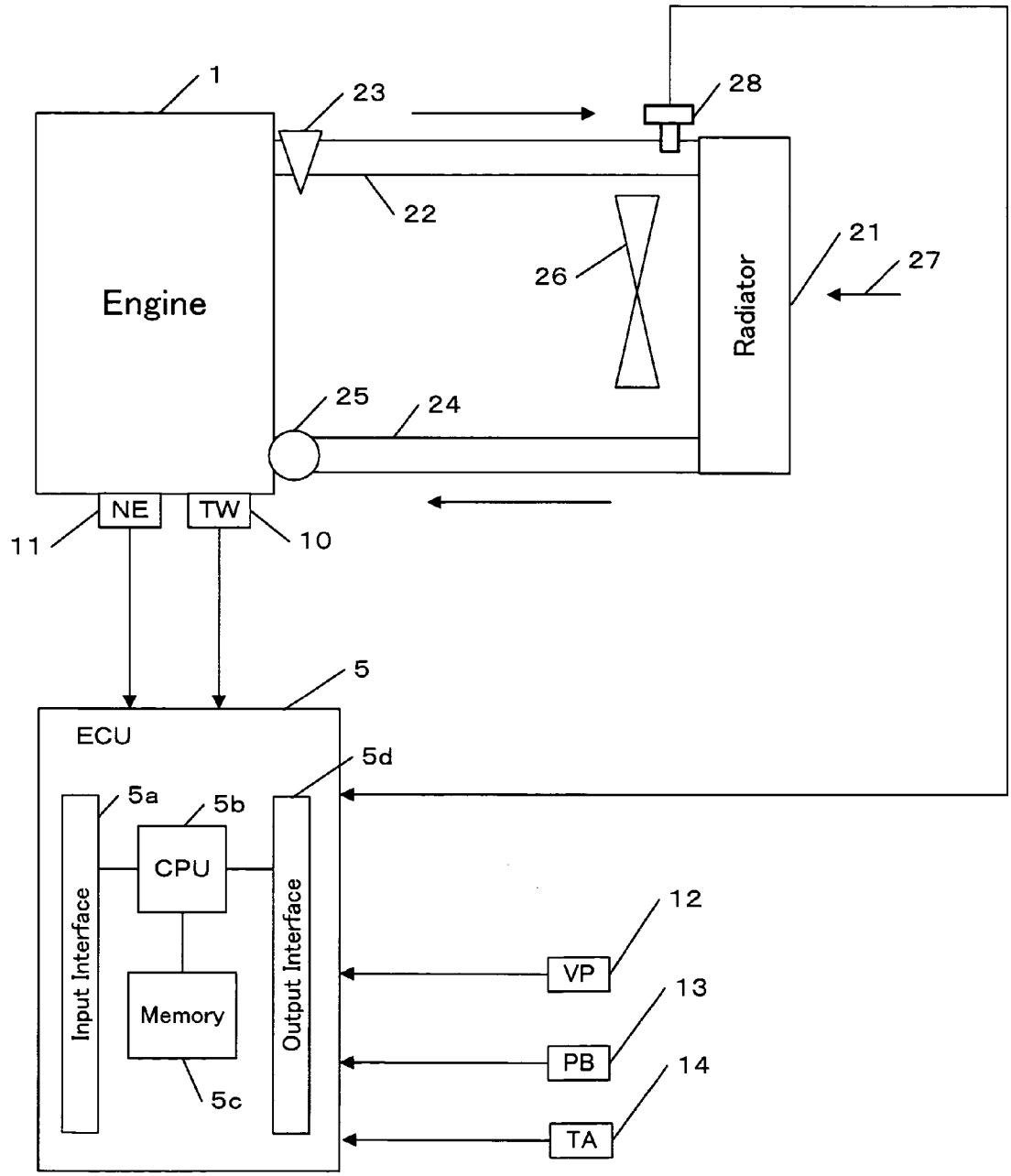
FIG. 1 shows a block diagram of an engine and its control unit in accordance with one embodiment of the present invention.

Preferred embodiments will be now described referring to the accompanying drawings. FIG. 1 schematically shows an engine and a control unit for the engine in accordance with one embodiment of the present invention.

An electronic control unit (hereinafter referred to as an "ECU") 5 comprises an input interface 5*a* for receiving data sent from each part of the engine 1, a CPU 5*b* for carrying out operations for controlling each part of the engine 1, a memory 5*c* including a read only memory (ROM) and a random access memory (RAM), and an output interface 5*d* for sending control signals to each part of the engine 1. Programs and various data for controlling each part of the vehicle are stored in the ROM. A program for performing a failure detection process according to the invention, data and tables used for operations of the program are stored in the ROM. The ROM may be a rewritable ROM such as an EPROM. The RAM provides work areas for operations by the CPU 5*a*, in which data sent from each part of the engine 1 as well as control signals to be sent out to each part of the engine 1 are temporarily stored.

An engine water temperature (Tw) sensor 10 is attached to the cylinder peripheral wall, which is filled with cooling water, of the cylinder block of the engine 1. A temperature TW of the cooling water detected by the sensor 10 is sent to the ECU 5.

A rotational speed (Ne) sensor 11 is attached to the periphery of the camshaft or the periphery of the crankshaft (not shown) of the engine 1. An engine rotational speed detected by the sensor 11 is sent to the ECU 5.

A vehicle speed (VP) sensor 12 is mounted in the periphery of a drive shaft (not shown) of the vehicle. A vehicle speed VP detected the sensor 12 is sent to the ECU 5.

An intake manifold pressure (Pb) sensor 13 and an intake air temperature (Ta) sensor 14 are mounted in an intake manifold (not shown) connected to the engine 1. A pressure Pb of the intake manifold and a temperature Ta of intake air introduced into the engine detected by the PB sensor 13 and Ta sensor 14 are sent to the ECU 5, respectively.

The engine 1 is connected to a radiator 21 through an inlet pipe (passage) 22, in which a thermostat 23 is disposed. The thermostat 23 is a bimetal valve. When the engine water temperature is lower than a predetermined thermostat opening temperature (for example, 75 degrees), the thermostat 23 closes the inlet pipe 22 so as to prevent the cooling water from flowing into the radiator 21 from the engine 1. On the other hand, when the engine water temperature is greater than the thermostat opening temperature, the thermostat 23 opens the inlet pipe 22 to allow the hot cooling water to flow from the engine 1 into the radiator 21.

Honeycomb-shaped cores (not shown) are provided in the radiator 21. Hot cooling water flowing from the inlet pipe 22 is cooled down while it flows through the cores. Then, the cooled cooling water is returned back to the engine 1 through an outlet pipe 24. Circulation of the cooling water from the outlet pipe 24 to the engine 1 is carried out by a water pump 25 that is driven by the engine output. Thus, when the thermostat 23 is open, the cooling water circulates from the engine 1, through the inlet pipe 22, the radiator 21 and the outlet pipe 24, back to the engine 1.

The cores of the radiator 21 are cooled down not only by the wind from the direction in which the vehicle is traveling as shown by an arrow 27 in FIG. 1 but also by a cooling fan 26 that is driven by the engine output.

A temperature sensor 28 for detecting a temperature of the cooling water flowing into the radiator 21 is disposed on the radiator side relative to the thermostat 23. In this example, the temperature sensor 28 is disposed in the inlet pipe 22. Alternatively, it may be disposed, for example, in the radiator 21. The temperature sensor 28 will be hereinafter referred to as a radiator water temperature (TR) sensor.

Figure 2:
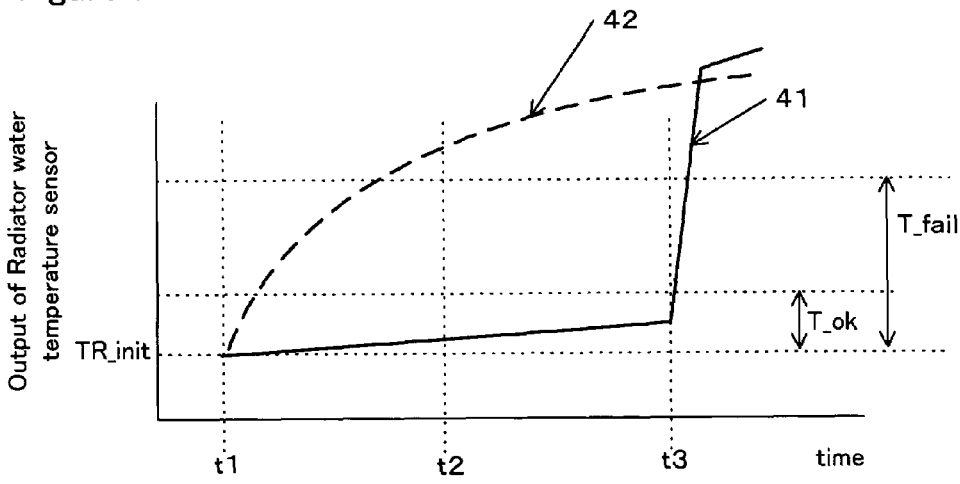
FIG. 2 schematically shows a basic concept of a method for detecting a failure of a thermostat in accordance with one embodiment of the present invention.

Referring to FIG. 2, a thermostat failure detection process in accordance with one embodiment of the present invention will be described. Reference number 41 shows the output of the radiator water temperature sensor 28 when a normal thermostat is used. The engine starts at time t1. TR_init indicates a temperature detected by the radiator water temperature sensor 28 when the engine started. During a time period from t1 to t3, the engine water temperature TW is below a predetermined thermostat opening temperature, so the thermostat 23 is in a closed state. Since the thermostat 23 is in a closed state, the cooling water from the engine 1 does not flow into the radiator 21. The output of the radiator water temperature sensor 28 is kept at a low value. At time t3, the engine water temperature reaches the thermostat opening temperature, so the thermostat 23 opens. Since the thermostat 23 opens, the cooling water of high temperature flows into the radiator 21 from the engine 1. As a result, the output of the radiator water temperature sensor 28 abruptly rises.

Reference number 42 shows the output of the radiator water temperature sensor 28 when there is a failure that the thermostat does not close. The thermostat is kept in an open state due to the failure for the time period from t1 to t3. Therefore, the output of the radiator water temperature sensor 28 rises as the engine water temperature TW increases. Such phenomenon may also occur when the thermostat cannot be fully closed and hence leakage is large.

According to one embodiment of the present invention, a failure of the thermostat is detected based on the output of the radiator water temperature sensor 28 when the engine has reached a desired warm condition during the time period from t1 to t3 (for example, at time t2). More specifically, it is determined that the thermostat is normal if the temperature detected by the radiator water temperature sensor 28 does not reach a normal determination value T_ok (for example, the initial water temperature TR_init+3 degrees). On the other hand, it is determined that the thermostat is faulty if the temperature detected by the radiator water temperature sensor 28 reaches a failure determination value T_fail (for example, the initial water temperature TR_init+15 degrees).

Figure 3:
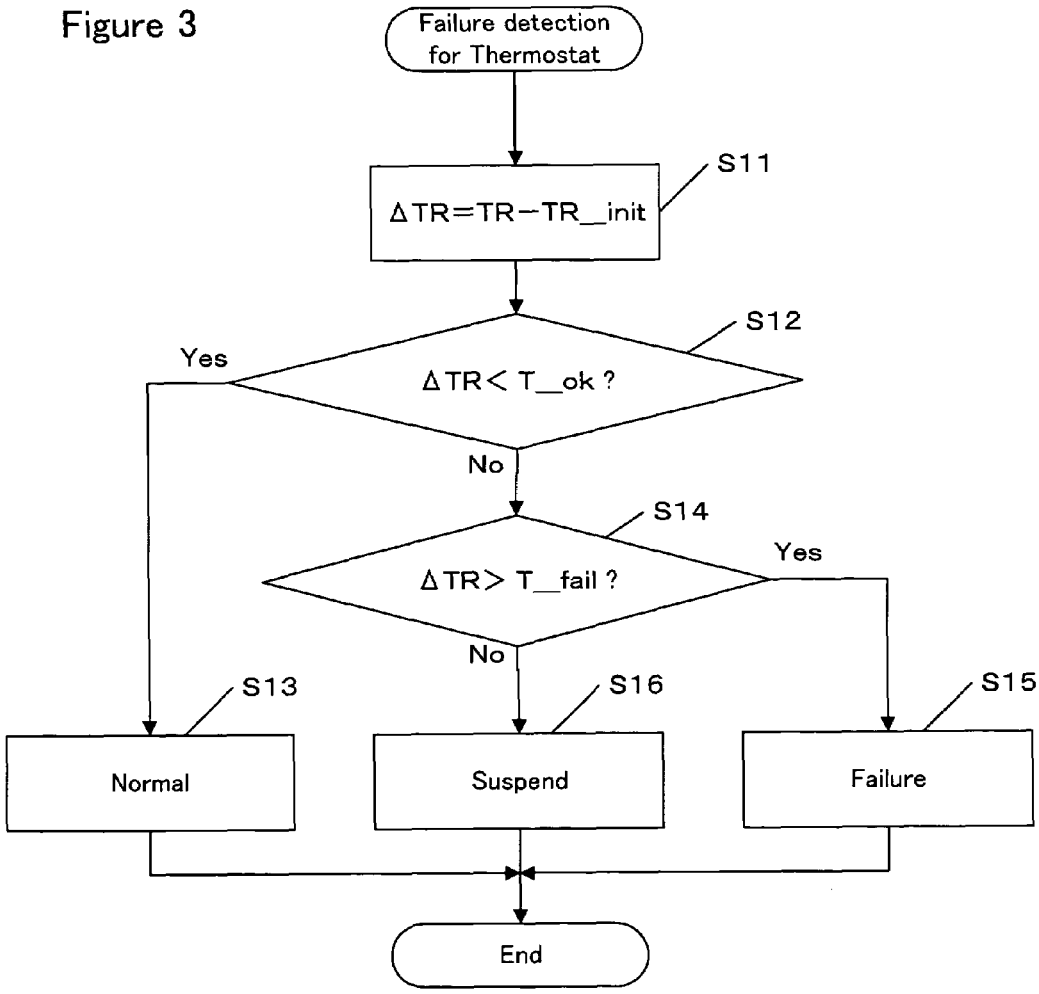
FIG. 3 shows a flowchart of a process for detecting a failure of a thermostat in accordance with one embodiment of the present invention.

FIG. 3 shows a flowchart for the failure detection process. In step S11, a difference ΔTR is calculated between the temperature TR detected by the radiator water temperature sensor 28 and the initial water temperature TR_init at the start of the engine detected by the radiator water temperature sensor 28. When the difference ΔTR is less than the normal determination value T_ok in step S12, it is determined that the thermostat is normal (S13). When the difference ΔTR is greater than the failure determination value T_fail in step S14, it is determined that the thermostat has a close failure (S15). When the difference is between the normal determination value and the failure determination value, the determination on whether the thermostat is normal or faulty is suspended in the current cycle (S16).

According to one embodiment of the present invention, such a failure detection process as shown in FIG. 3 is activated by the ECU 5 when the engine is in a predetermined warm condition. The predetermined warm condition meets the requirements: (1) where the engine water temperature is lower than the thermostat opening temperature and (2) where the amount of heat generation of the engine exceeds a predetermined value.

The requirement (1) is provided so as to carry out the failure detection process under a condition where the thermostat is in a closed state if the thermostat is normal. A failure of the thermostat can be detected by examining the amount of change in the output TR of the radiator water temperature sensor 28 for the time period from t1 to t3 as shown in FIG. 2.

The requirement (2) is provided so as to carry out the failure detection process under a condition where the engine is warm. If the engine is not warm, the output of the radiator water temperature sensor 28 is low regardless of whether the thermostat is open or closed. Under such a condition, there is little difference in the output of the radiator water temperature sensor 28 between a normal thermostat and a faulty thermostat. As a result, a failure of the thermostat may not be accurately detected.

Referring to some specific embodiments, it will be described how to identify the warm condition appropriate to the thermostat failure detection process. Processes in the flowcharts that will be described below for each embodiment are typically implemented by computer programs stored in the ECU 5. Alternatively, the processes may be implemented by software, firmware, hardware or any combination thereof.

Figure 4:
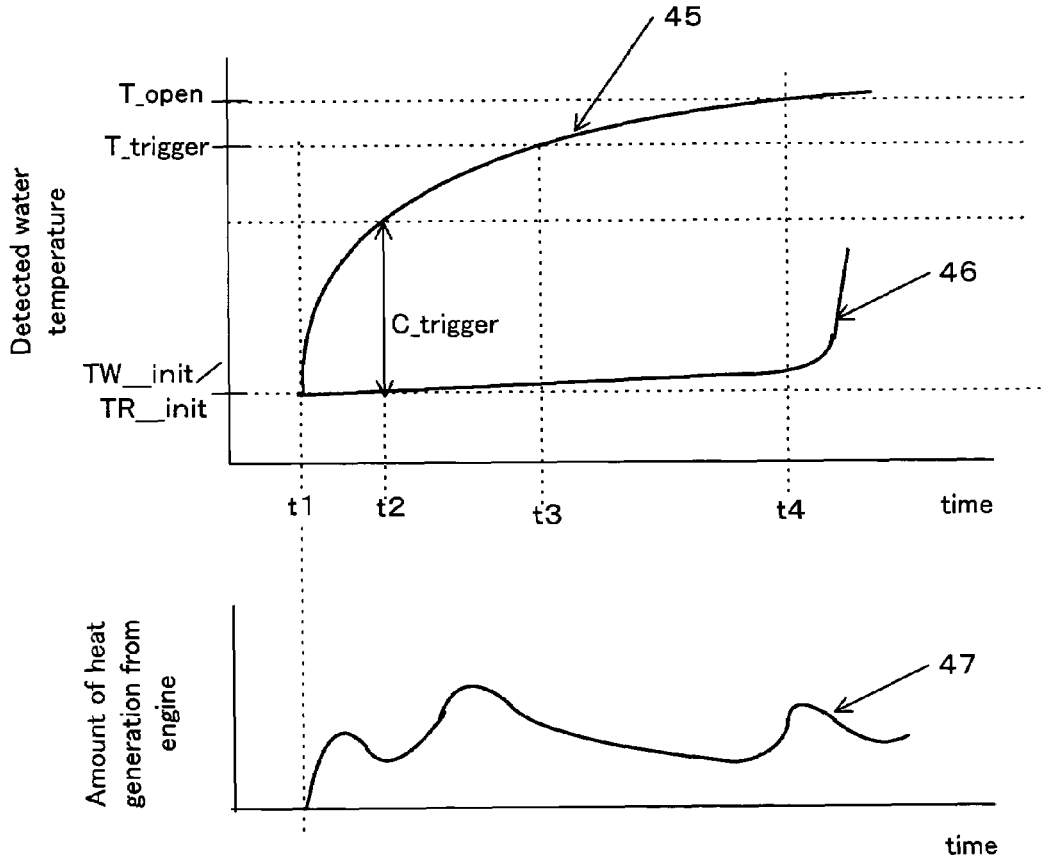
FIG. 4 schematically shows timing for activating a thermostat failure detection process in accordance with a first embodiment of the present invention.

A first embodiment of the present invention will be described referring to FIG. 4. In this embodiment, the output of the engine water temperature (TW) sensor 10 is used to determine whether the engine has reached a warm condition appropriate to the thermostat failure detection process.

Reference numbers 45 and 46 show the output of the engine water temperature sensor 10 and the output of the radiator water temperature sensor 28, respectively, when the thermostat is normal. Reference number 47 shows an example of the amount of heat generation of the engine.

The engine starts at time t1. The output of the engine water temperature sensor and the output of the radiator water temperature sensor when the engine starts are represented by TW_init and TR_init, respectively (hereinafter referred to as the engine initial water temperature and the radiator initial water temperature, respectively). A temperature at which the thermostat 23 opens (for example, 75 degrees) is represented by T_open.

The radiator water temperature TR is low until the engine water temperature TW reaches the thermostat opening temperature T_open (that is, during a period from t1 to t4) because the thermostat 23 is in a closed state.

A warm condition appropriate to the thermostat failure detection process can be identified by the engine water temperature TW. When the engine water temperature TW reaches a predetermined trigger temperature T_trigger (at time t3), it is determined that the engine has reached the warm condition appropriate to the thermostat failure detection process, activating the failure detection process as shown in FIG. 3. The trigger temperature T_trigger is set to be slightly lower than the thermostat opening temperature T_open (for example, 70 degrees).

The warm condition appropriate to the failure detection process can be also identified by the amount of change in the engine water temperature TW. When the amount of change in the engine water temperatures TW reaches a predetermined trigger value C_trigger (for example, 30 degrees) at time t2, it is determined that the engine has reached the warm condition appropriate to the thermostat failure detection process, activating the failure detection process. The amount of change in the engine water temperatures TW can be considered as the amount of heat generation of the engine. Accordingly, even when the engine water temperature is still below the trigger temperature T_trigger, it can be determined that sufficient heat to perform the failure detection process is generated by the engine if the amount of change in the engine water temperature TW exceeds the trigger value C_trigger.

Figure 5:
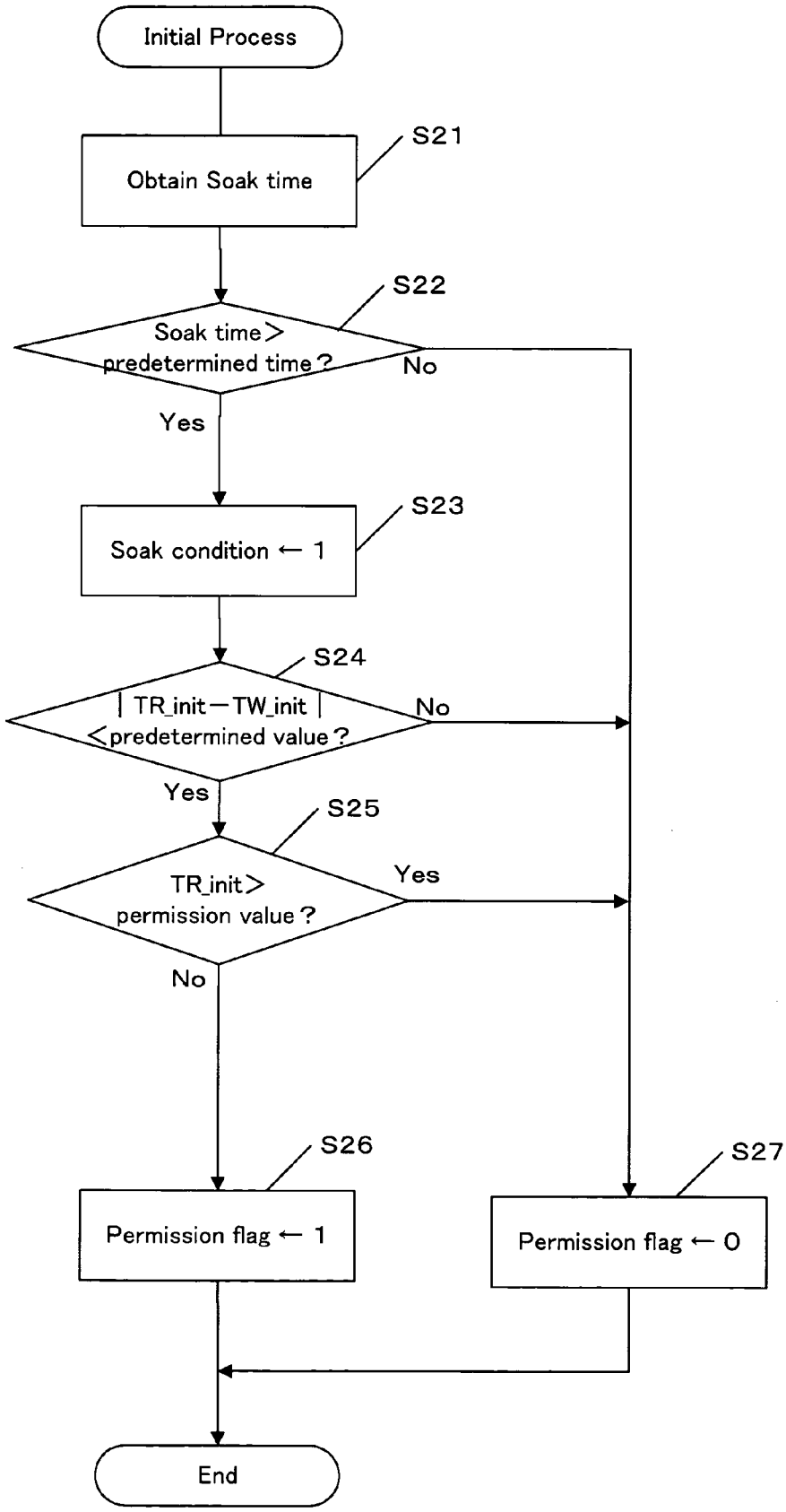
FIG. 5 shows a flowchart of an initial process in accordance with a first embodiment of the present invention.

FIG. 5 is a flowchart of an initial process that is performed when the engine starts, in accordance with the first embodiment.

In step S21, a soak time is obtained. The soak time indicates an elapsed time since the engine was turned off and left. If the soak time has not reached a predetermined time (S22), it is determined that the engine is not in a soaked condition. That is, it is determined that the engine has not been sufficiently cooled. In such a condition, the thermostat failure detection process is prohibited (S27) because a failure may not be detected accurately when the engine water temperature is high. When the soak time has reached the predetermined time, it is determined that the engine is in the soaked condition (S23).

In step S24, if a difference between the radiator initial water temperature TR_init and the engine initial water temperature TW_init is equal to or more than a predetermined value, the failure detection process is prohibited (S27). If the difference between the engine water temperature and the radiator water temperature is large when the engine is in the soak condition, there may be some failure in the engine, sensors and so on. In such a condition, the failure detection process is prohibited because a failure of the thermostat may not be detected accurately.

In step S25, when the radiator initial water temperature TR_init is greater than a predetermined permission value, the failure detection process is prohibited (S27). In the present invention, as described above referring to FIG. 2, a failure of the thermostat is detected based on the amount of change in the radiator water temperature TR. If the radiator initial water temperature is too high, the failure detection process is prohibited because a failure of the thermostat may not be detected accurately.

In step S26, a permission flag is set to one, indicating that the thermostat failure detection process is permitted.

Figure 6:
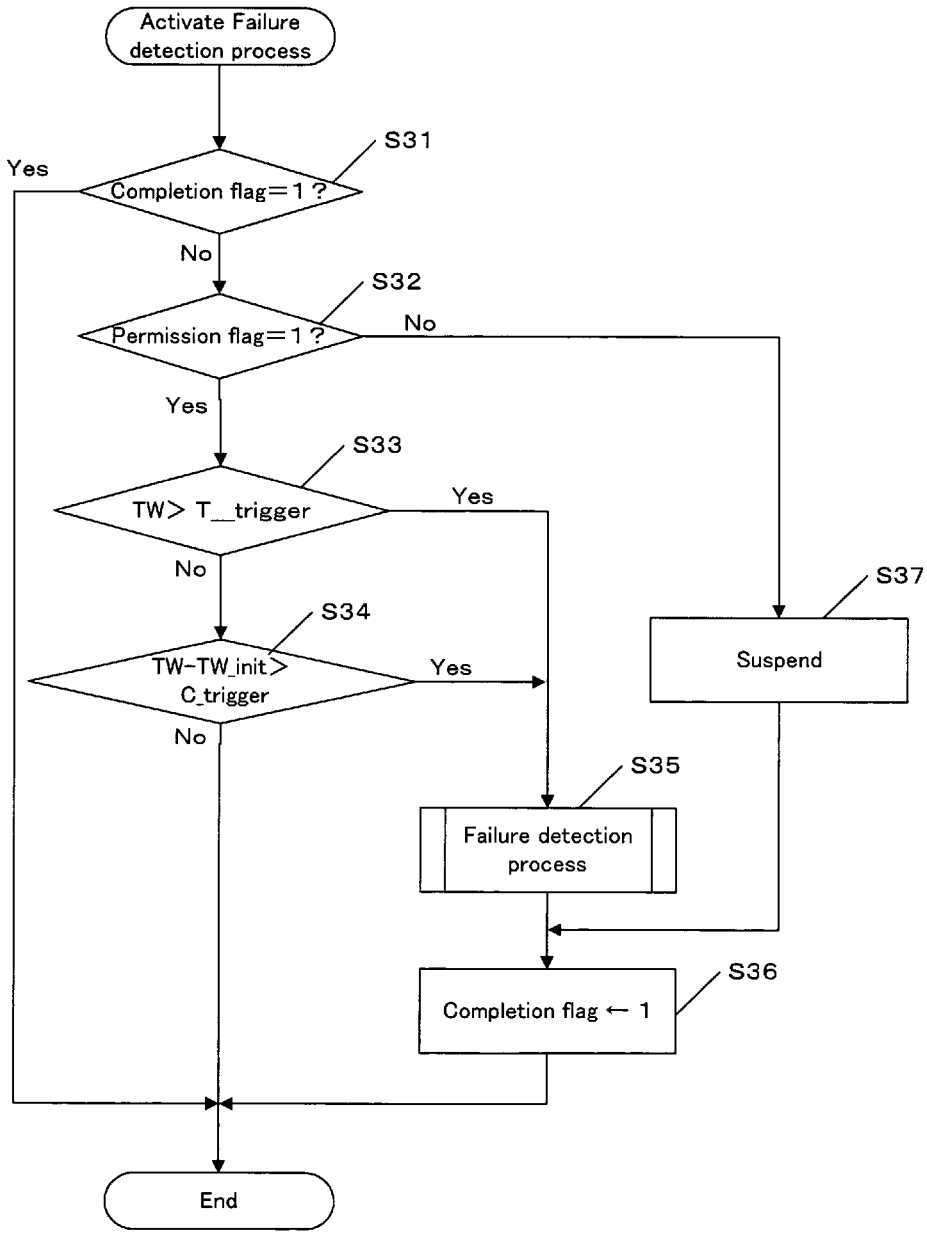
FIG. 6 shows a flowchart of a process for activating a thermostat failure detection process in accordance with a first embodiment of the present invention.

FIG. 6 shows a flowchart of a process for activating the thermostat failure detection process in accordance with the first embodiment. This process is performed at a predetermined time interval.

This process is carried out when the failure detection process has not been completed and the failure detection process is permitted (S31 and S32). If the failure detection process is not permitted, the determination on whether the thermostat is normal or faulty is suspended (S37).

In step S33, if the detected engine water temperature TW is higher than the trigger temperature T_trigger, the failure detection process as shown in FIG. 3 is activated to detect a failure of the thermostat (S35). Even when the engine water temperature TW has not reached the trigger temperature T_trigger, the failure detection process as shown in FIG. 3 is activated to detect a failure of the thermostat (S35) if a difference between the engine initial water temperature TW_init and the current engine water temperature TW is greater than the trigger value C_trigger (S34). If the failure detection process is completed, a completion flag is set to one (S36).

Figures 7, 8:
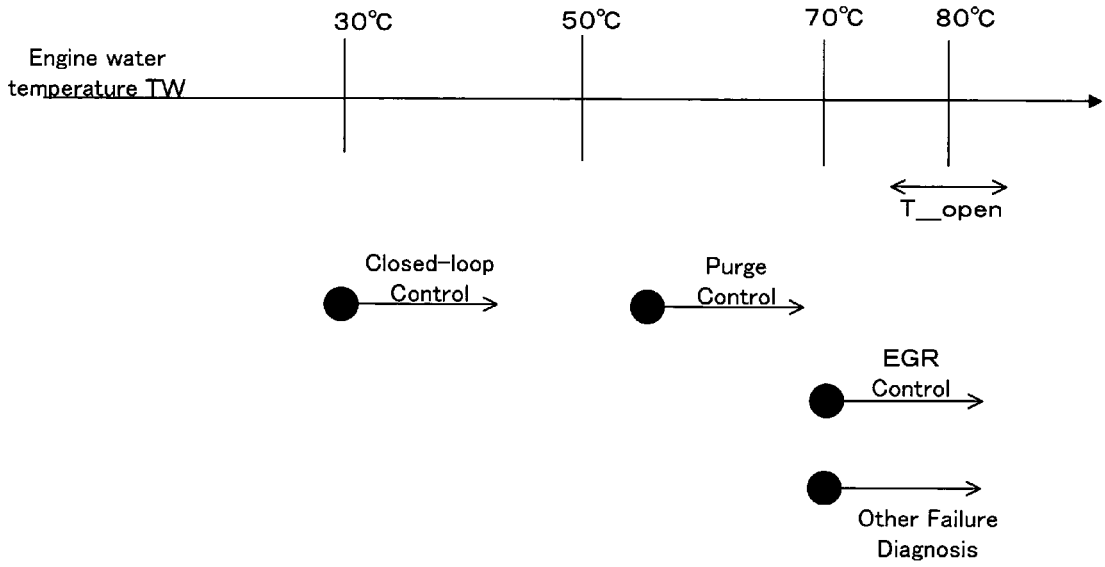
FIG. 7 schematically shows timing for activating a thermostat failure detection process in accordance with a second embodiment of the present invention.
FIG. 8 shows a table for vehicle-related processes which serve as a trigger for activating a thermostat failure detection process in accordance with a second embodiment of the present invention.

Referring to FIG. 7, a second embodiment of the present invention will be described. In this embodiment, a warm condition appropriate to the thermostat failure detection process is identified by activation of a vehicle-related process that is configured to be performed when the engine is in such a warm condition. In response to the activation of a vehicle-related process, the failure detection process is activated.

As one example, such a vehicle-related process is shown in FIG. 7. A closed loop control is started when the engine water temperature TW has reached about 30 degrees. Such closed loop control includes, for example, a feedback control such as an air-fuel ratio feedback control or the like. A purge control is started when the engine water temperature TW has reached about 50 degrees. When the engine water temperature TW has reached about 70 degrees, an EGR control and other failure diagnosis processes (for example, a failure detection process for various sensors, a fuel leakage detection process and so on) are started. These vehicle-related processes are started at a lower engine water temperature than the thermostat opening temperature T_open.

A table as shown in FIG. 8 may be stored in the memory 5*c* of the ECU 5. By referring to such a table based on the radiator initial water temperature TR_init (or the engine initial water temperature TW_init), it is determined which vehicle-related process is used as a trigger.

For example, when the radiator initial water temperature TR_init is less than 5 degrees, the failure detection process is activated in response to a flag F_CloseLoop being set, which indicates that a closed loop control is started. When the radiator initial water temperature TR_init is equal to or more than 5 degrees and less than 25 degrees, the failure detection process is activated in response to a flag F_Purge being set, which indicates that a purge control is started. When the radiator initial water temperature TR_init is equal to or more than 25 degrees, the failure detection process is activated in response to a flag F_EGR being set, which indicates that an EGR control is started. Thus, by selecting a vehicle-related process that is to be used as a trigger in accordance with the radiator initial water temperature TR_init, a desired warm condition for the failure detection process is detected, improving the frequency of performing the failure detection process.

Figure 9:
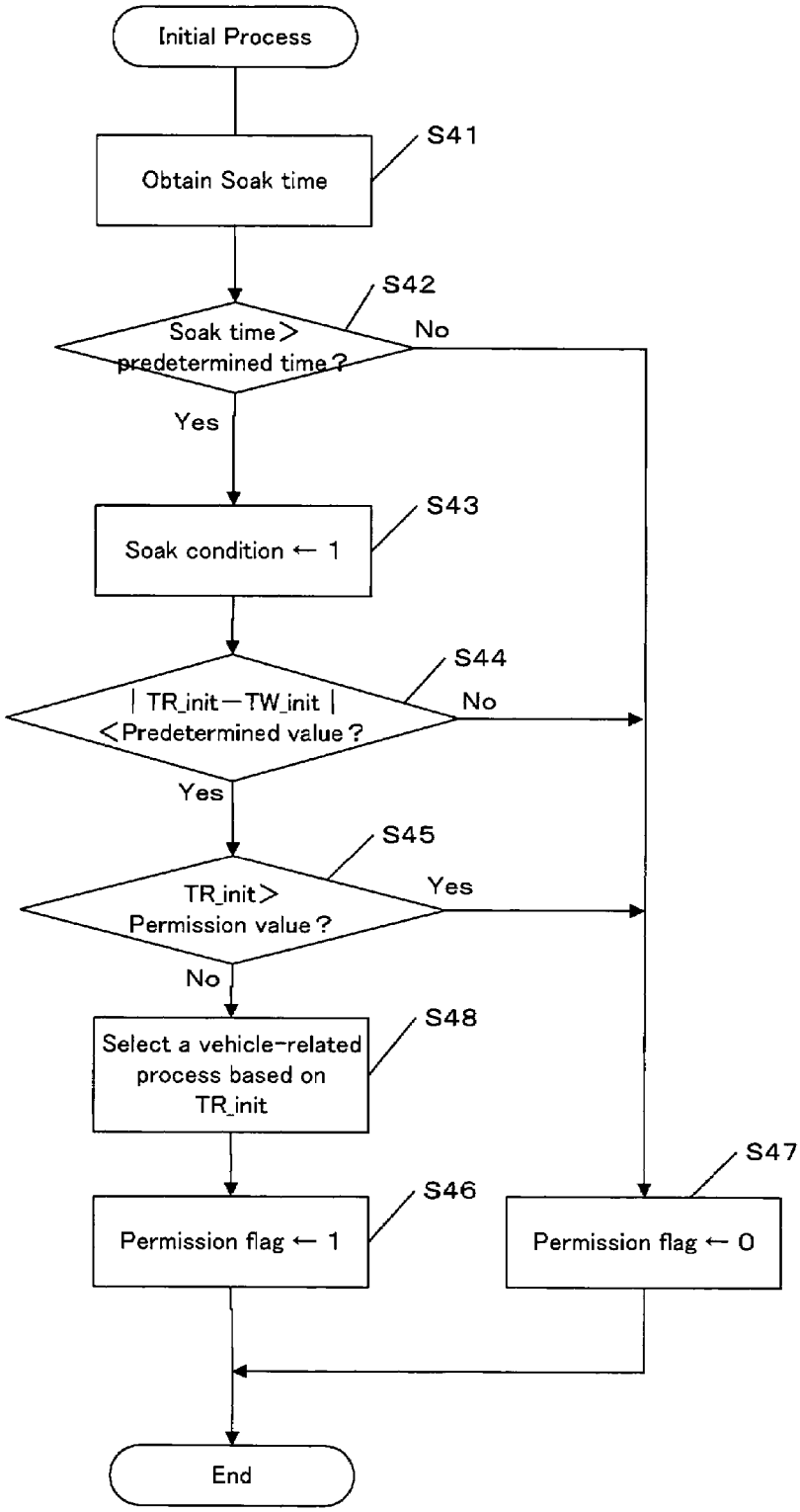
FIG. 9 shows a flowchart of an initial process in accordance with a second embodiment of the present invention.

FIG. 9 is a flowchart of an initial process that is performed when the engine starts in accordance with the second embodiment. Steps S41 through S47 are the same as Steps S21 through S27 shown in FIG. 5. In step S48, the process refers to a table as shown in FIG. 8 to select a vehicle-related process corresponding to the detected radiator initial water temperature TR_init.

Figure 10:
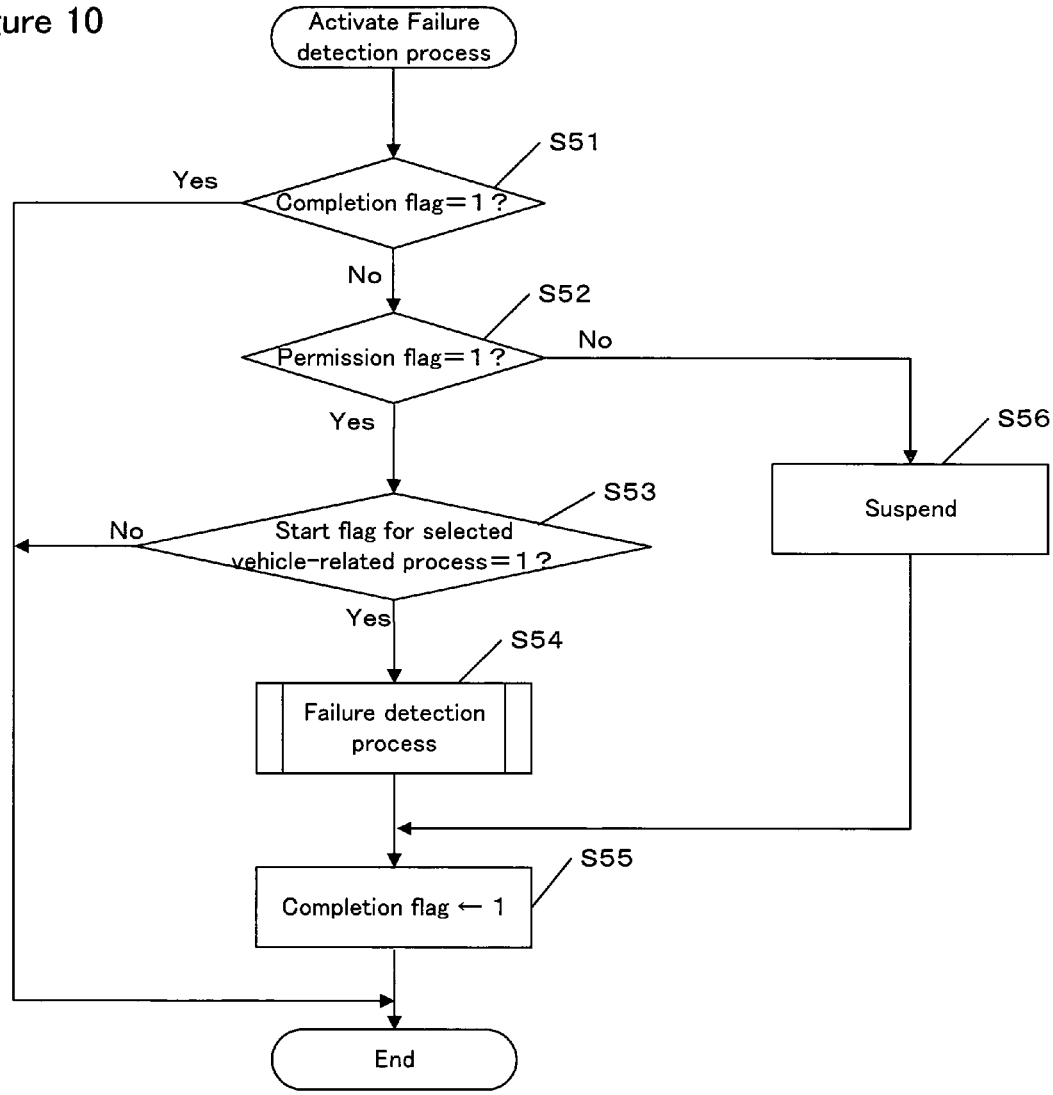
FIG. 10 shows a flowchart of a process for activating a thermostat failure detection process in accordance with a second embodiment of the present invention.

FIG. 10 shows a flowchart of a process for activating the thermostat failure detection process in accordance with the second embodiment. This process is performed at a predetermined time interval.

This process is performed when the thermostat failure detection process has not been completed and the failure detection process is permitted (S51 and S52). If the failure detection process is not permitted, the determination on whether the thermostat is normal or faulty is suspended (S56).

In step S53, it is determined whether a start flag of the vehicle-related process selected in step S48 (FIG. 9) has been set. If the start flag has been set, the failure detection process as shown in FIG. 3 is activated to detect a failure of the thermostat (S54). A completion flag is set to one in step S55.

Alternatively, interruption may be generated in response to the start flag of the selected vehicle-related process being set, so as to activate the thermostat failure detection process as shown in FIG. 3.

A third embodiment of the present invention will be now described. In this embodiment, the level of warm condition of the engine is examined. When it is determined that the warm condition of the engine has reached a level appropriate to the thermostat failure detection process, the thermostat failure detection process is activated.

A level appropriate to the thermostat failure detection process can be determined in accordance with the radiator initial water temperature TR_init (or the engine initial water temperature TW_init) as shown in a table of FIG. 11. When the radiator initial water temperature TR_init is less than zero degree, the warm condition appropriate to the failure detection process is a condition where the engine water temperature TW is within a range from 30 to 50 degrees. This level is represented by a value of "1".

When the radiator initial water temperature TR_init is equal to or more than zero degree and less than 20 degree, the warm condition appropriate to the failure detection process is a condition where the engine water temperature TW is within a range from 50 to 70 degrees. This level is represented by a value of "2". When the radiator initial water temperature TR_init is equal to or more than 20 degrees and less than 50 degrees, the warm condition appropriate to the failure detection process is a condition where the engine water temperature TW is within a range from 70 to 100 degrees. This level is represented by a value of "3". A table as shown in FIG. 11 may be stored in the memory 5*c*. It should be noted that the number of levels, the engine water temperature in each level, and the value of each level shown in FIG. 11 are one example.

Figure 12:
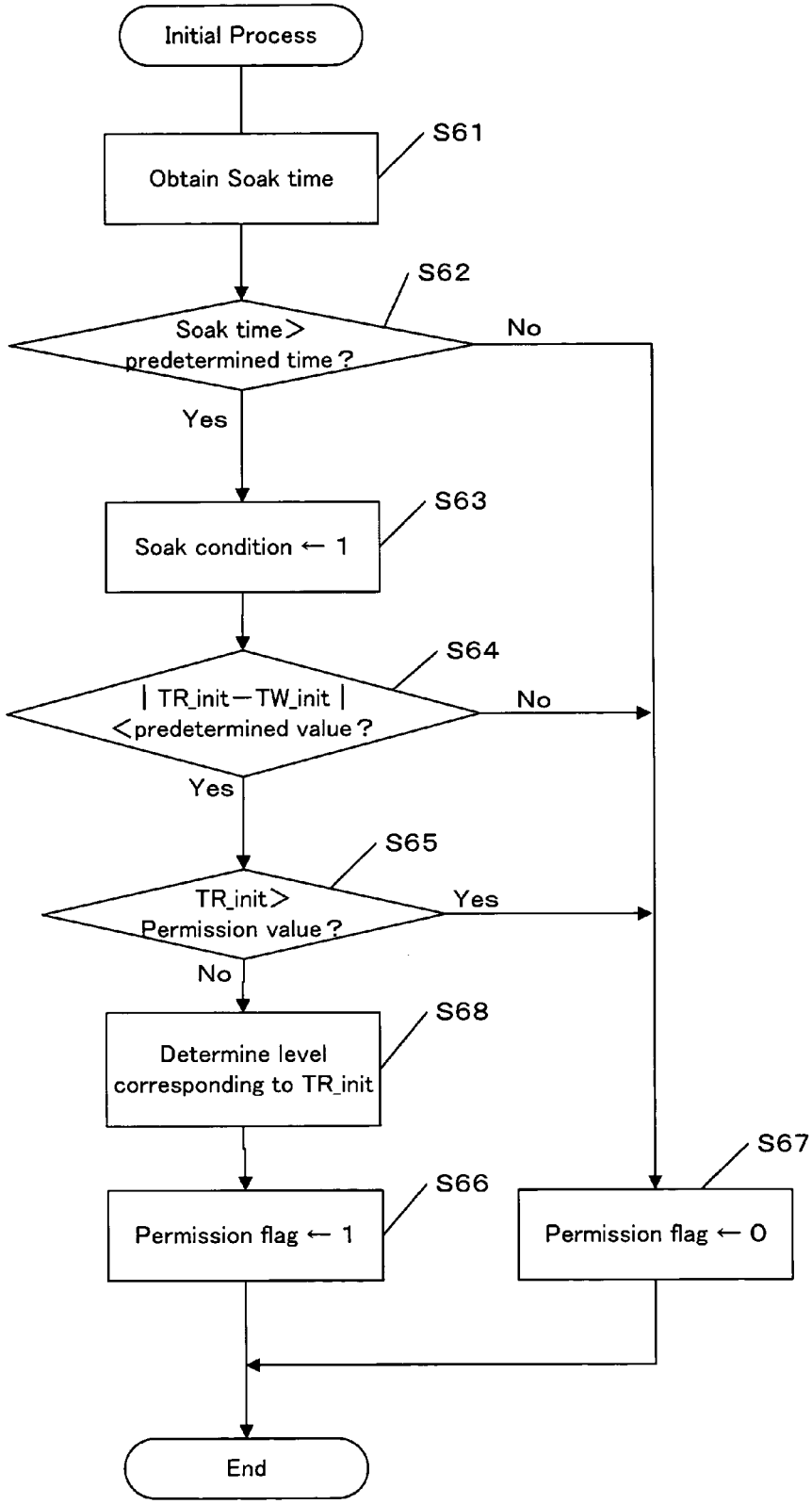
FIG. 12 shows a flowchart of an initial process in accordance with a third embodiment of the present invention.

FIG. 12 is a flowchart of an initial process that is performed when the engine starts in accordance with the third embodiment of the present invention. Steps S61 through S67 are the same as steps S21 through S27 as shown in FIG. 5. In step S68, the process refers to a table as shown in FIG. 11 based on the radiator initial water temperature TR_init to determine a level of the warm condition.

Figure 13:
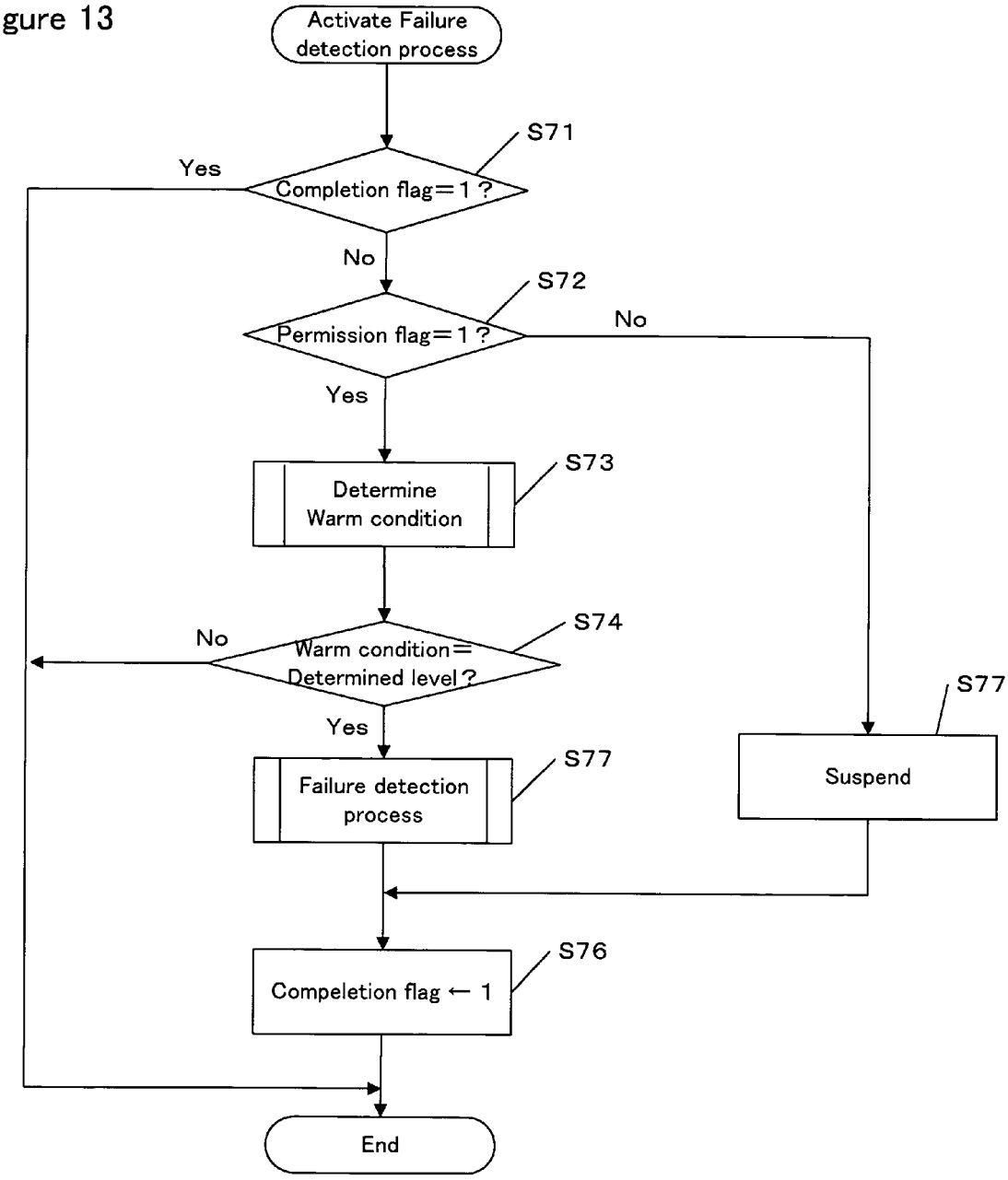
FIG. 13 shows a flowchart of a process for activating a thermostat failure detection process in accordance with a third embodiment of the present invention.

FIG. 13 shows a flowchart of a process for activating the thermostat failure detection process in accordance with the third embodiment of the present invention.

This process is carried out when the thermostat failure detection process has not been completed and the thermostat failure detection process is permitted (S71 and S72). If the failure detection process is not permitted, the determination on whether the thermostat is normal or faulty is suspended (S77).

In step S73, a process for determining a level of the current warm condition of the engine is performed. In step S74, it is determined whether the level of the current warm condition matches the level determined in step S68 of the initial process (FIG. 12). If the decision of step S74 is Yes, the failure detection process as shown in FIG. 3 is activated to detect a failure of the thermostat (S75). In step S76, the completion flag is set to 1.

Figure 14:
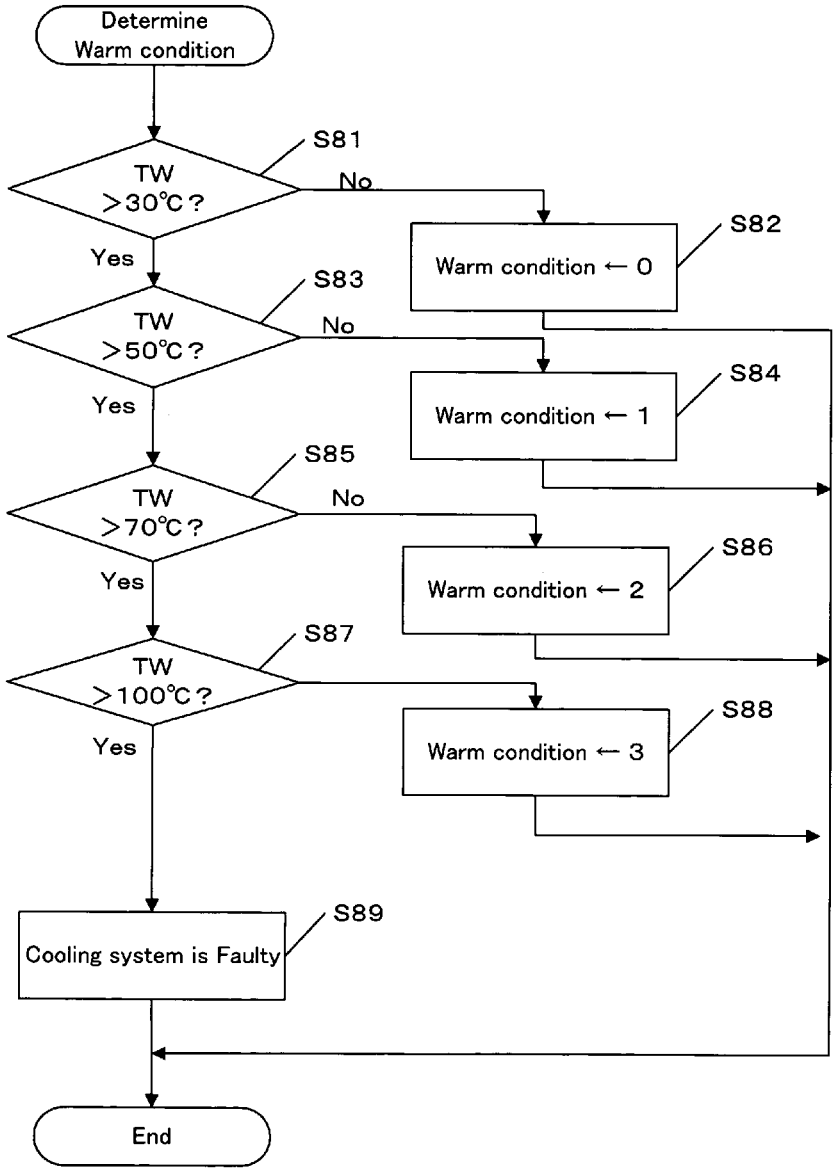
FIG. 14 shows a flowchart of a process for determining a warm condition in accordance with a third embodiment of the present invention.

FIG. 14 is a flowchart of a process that is performed in step S73 of FIG. 13 to determine a level of the current warm condition of the engine. In step S81, if the engine water temperature TW is equal to or less than 30 degrees, the warm condition level is set to "0" (S82). The level "0" indicates that the engine is in a cold condition.

In step S83, if the engine water temperature TW is between 30 degrees and 50 degrees, the warm condition level is set to "1" (S84). In step S85, if the engine water temperature TW is between 50 degrees and 70 degrees, the warm condition level is set to "2" (S86). In step S87, if the engine water temperature TW is between 70 degrees and 100 degrees, the warm condition level is set to "3" (S88).

If the engine water temperature is greater than 100 degrees, it indicates that a cooling system may not be working appropriately. In step S89, it is determined that there is a failure in a cooling system.

Thus, the level of warm condition appropriate to the thermostat failure detection process is determined in accordance with the initial water temperature of the engine or the radiator. Since a desired warm condition is appropriately detected, the frequency of performing the failure detection process is increased. Since the warm condition of the engine is determined hierarchically as shown in FIG. 14, it can be easily determined whether the warm condition appropriate to the failure detection process is achieved.

Alternatively, the warm condition may be determined by using an oil temperature that has a correlation with the engine water temperature.

Figure 15:
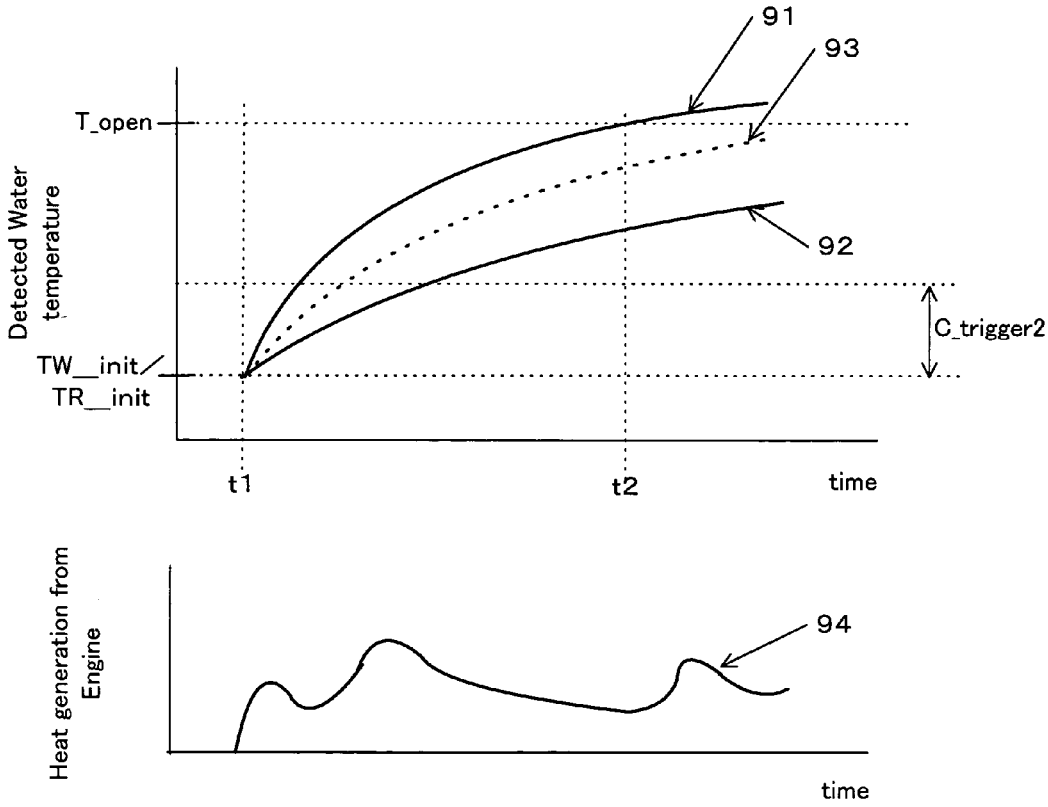
FIG. 15 schematically shows timing for activating a thermostat failure detection process in accordance with a fourth embodiment of the present invention.

Referring to FIG. 15, a fourth embodiment of the present invention will be described. A portion of the heat generated from the engine is consumed by a heater mounted on the vehicle. Such a loss of the heat due to the heater will be hereinafter referred to as a heater cooling loss. A portion of the heat generated from the engine is also lost by the wind hitting the radiator and the engine body. Such a loss of the heat due to the wind will be hereinafter referred to as a wind cooling loss. A speed that the engine water temperature rises changes depending on a cooling loss that includes the heater cooling loss and the wind cooling loss. As the cooling loss increases, the speed slows down. The engine water temperature can be estimated from the amount of heat generation of the engine and the cooling loss.

Reference number 91 shows an estimated value CTW1 for the engine water temperature (which will be hereinafter referred to as a first estimated value) when the cooling loss is minimum. Reference number 92 shows an estimated value CTW2 for the engine water temperature (which will be hereinafter referred to as a second estimated value) when the cooling loss is maximum. An actual engine water temperature falls between the curves 91 and 92, as shown by reference number 93. That is, CTW2<actual engine water temperature TW<CTW1. Reference number 94 shows an example of the amount of heat generated from the engine. The engine starts at time t1.

A requirement where the thermostat failure detection process is performed before the engine water temperature reaches the thermostat opening temperature T_open (for example, 75 degrees) can be specified by the first estimated value CTW1. Since reference number 91 indicates a case where the engine water temperature increases at a maximum speed, the thermostat failure detection process can be performed when the first estimated value CTW1 has reached the thermostat opening temperature T_open.

A requirement where the thermostat failure detection process is performed when the amount of heat generation of the engine has reached a predetermined value can be specified by the second estimated value CTW2. Since reference number 92 indicates a case where the engine water temperature increases at a minimum speed, the thermostat failure detection process can be started when the amount of change in the second estimated value CTW2 is greater than a predetermined value C_trigger2 (for example, 20 degrees).

In summary, the thermostat failure detection process is activated if the amount of change in the second estimated value CTW2 is greater than the predetermined value C_trigger2 when the first estimated value CTW1 has reached the thermostat opening temperature T_open. In FIG. 15, this requirements are satisfied at time t2, activating the thermostat failure detection process.

Figure 16:
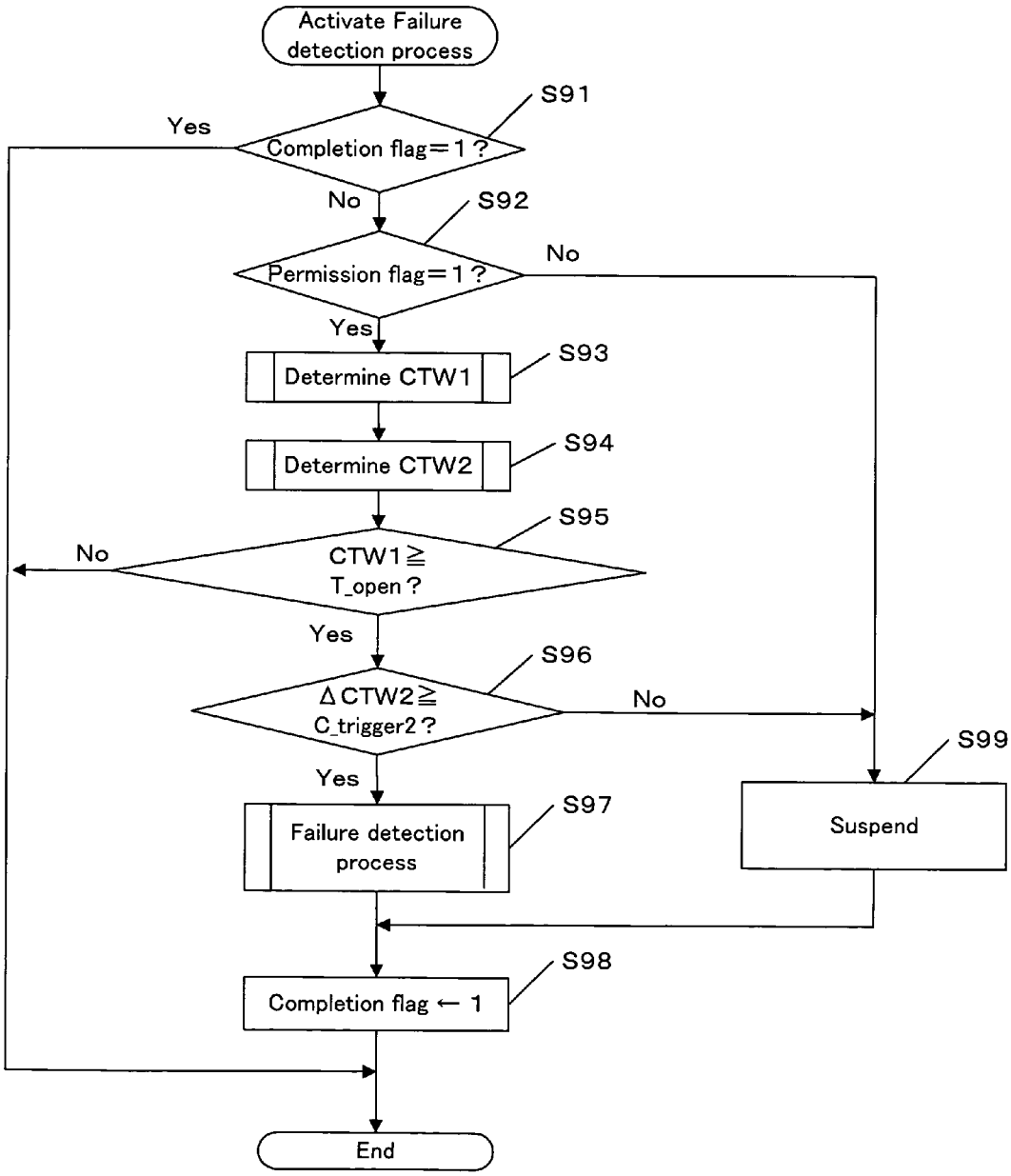
FIG. 16 shows a flowchart of a process for activating a thermostat failure detection process in accordance with a fourth embodiment of the present invention.

FIG. 16 is a flowchart of a process for activating the thermostat failure detection process in accordance with the fourth embodiment of the present invention. This process is performed at a predetermined time interval. Since the initial process shown in FIG. 5 can be applied to the fourth embodiment, its description is omitted herein.

This process is carried out when the thermostat failure detection process has not been completed and the thermostat failure detection process is permitted (S91 and S92). If the failure detection process is not permitted, the determination on whether the thermostat is normal or faulty is suspended (S99).

In step S93, a process (FIG. 19) is performed for determining the first estimated value CTW1 for the case where the cooling loss is minimum. In step S94, a process (FIG. 22) is performed for determining the second estimated value CTW2 for the case where the cooling loss is maximum.

In step S95, if the first estimated value CTW1 has not reached the thermostat opening temperature T_open, this process terminates. In step S95 and step S96, if the amount of change in the second estimated value CTW2 is equal to or more than the predetermined value C_trigger2 when the first estimated value CTW1 has reached the thermostat opening temperature T_open, the thermostat failure detection process is activated (S97). If the amount of change in the second estimated value CTW2 is less than C_trigger2 when the first estimated value CTW1 has reached the thermostat opening temperature T_open, the determination is suspended (S99). In step S98, the completion flag is set to one.

Figure 17:
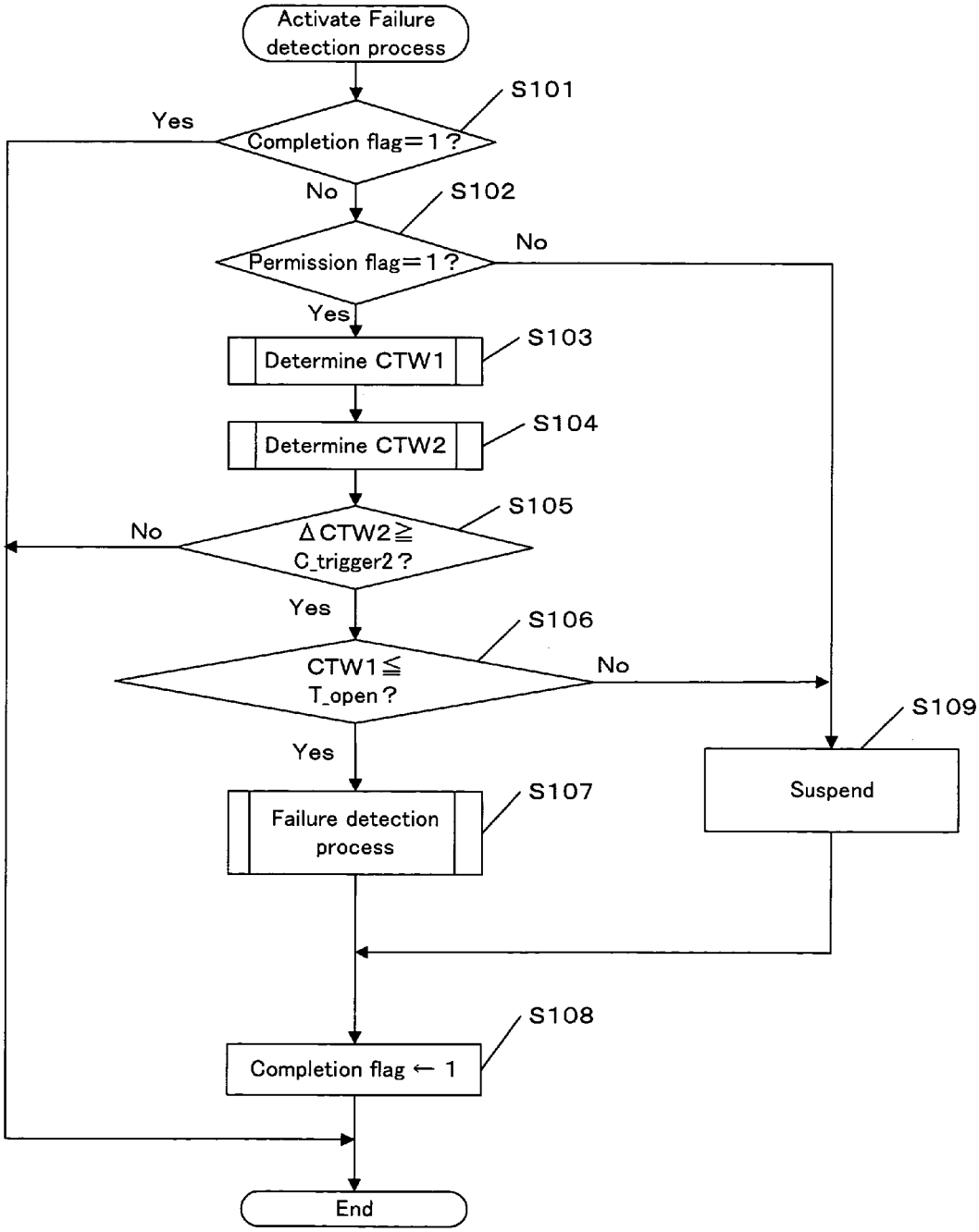
FIG. 17 shows a flowchart of another process for activating a thermostat failure detection process in accordance with a fourth embodiment of the present invention.

As described referring to FIG. 15, in the fourth embodiment, a condition where the engine water temperature is lower than the thermostat opening temperature T_open and the amount of heat generation of the engine is greater than the predetermined value is detected by using the first estimated value CTW1 and the second estimated value CTW2. In FIG. 16, such a condition is detected by examining whether the amount of change in the second estimated value CTW2 is greater than C_trigger2 when the first estimated value CTW1 has reached the thermostat opening temperature T_open. Alternatively, such a condition may be detected by examining whether the first estimated value CTW1 is less than the thermostat opening temperature T_open when the amount of change in the second estimated value CTW2 has reached C_trigger2. This process is shown in FIG. 17. All of the steps except for steps S105 and S106 are the same as those shown in FIG. 16.

In step S105, if the amount of change in the second estimated value CTW2 has not reached C_trigger2, this process terminates. In steps S105 and S106, if the first estimated value CTW1 is equal to or less than the thermostat opening temperature T_open when the amount of change in the second estimated value CTW2 has reached C_trigger2, the thermostat failure detection process shown in FIG. 3 is activated to detect a failure of the thermostat (S107).

Alternatively, in step S95 of FIG. 16 and step S106 of FIG. 17, a temperature slightly lower than the thermostat opening temperature T_open (for example, T_open-3 degrees) may be used instead of the thermostat opening temperature T_open.

In the examples of FIG. 16 and FIG. 17, the second estimated value CTW2 is used to determine whether the amount of heat generation of the engine is sufficient to perform the thermostat failure detection process. Alternatively, only the first estimated value CTW1 may be used so as to determine whether the amount of heat generation of the engine is sufficient to perform the thermostat failure detection process. For example, when the engine is cold-started and the cooling loss is small, a timing for performing the thermostat failure detection process may be identified based on the first estimated value CTW1.

Figure 18:
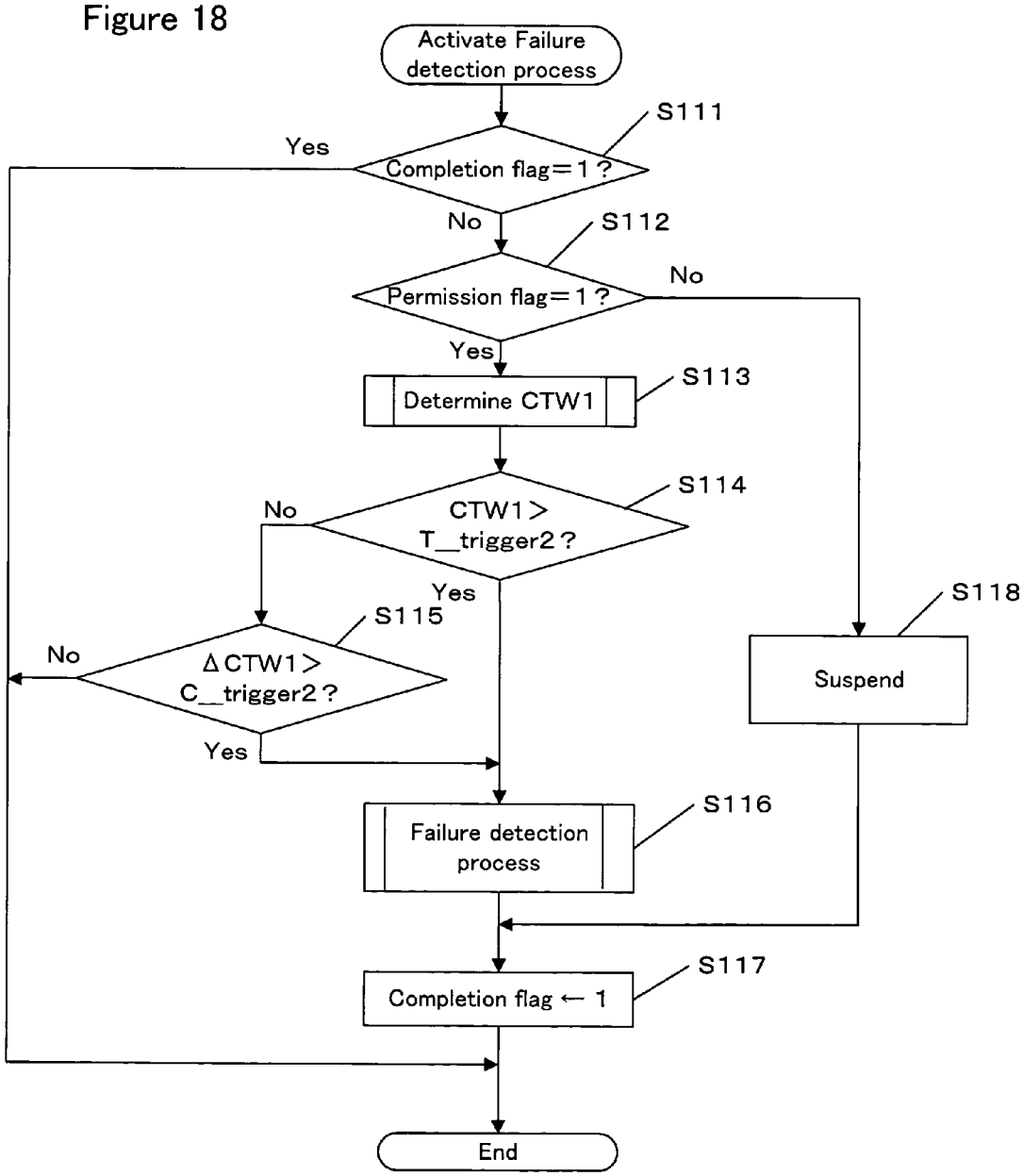
FIG. 18 shows a flowchart of a process for activating a thermostat failure detection process in accordance with a fourth embodiment of the present invention.

FIG. 18 shows a flowchart of a process for detecting a warm condition based on only the first estimated value CTW1. Steps except for S114 and S115 are the same as those shown in FIG. 16 (however, the routine for determining the second estimated value CTW2 is not performed).

In step S114, if the first estimated value CTW1 has reached a predetermined trigger temperature T_trigger2, the thermostat failure detection process as shown in FIG. 3 is activated to detect a failure of the thermostat (S116). The trigger temperature T_trigger2 is set to the thermostat valve temperature T_open (for example, 75 degrees) or a temperature (for example, 70 degrees) slightly lower than the thermostat opening temperature T_open.

In step S114, if the first estimated value CTW1 has not reached the trigger temperature T_trigger2, it is determined whether the amount of change ΔACTW1 in the first estimated value CTW1 is greater than a predetermined value C_trigger2 (for example, 30 degrees).

If the amount of change ΔCTW1 in the first estimated value is greater than C_trigger2, it indicates that a sufficient amount of heat to perform the thermostat failure detection process is generated from the engine. In such a case, the thermostat failure detection process as shown in FIG. 3 is activated to detect a failure of the thermostat (S116).

Figure 19:
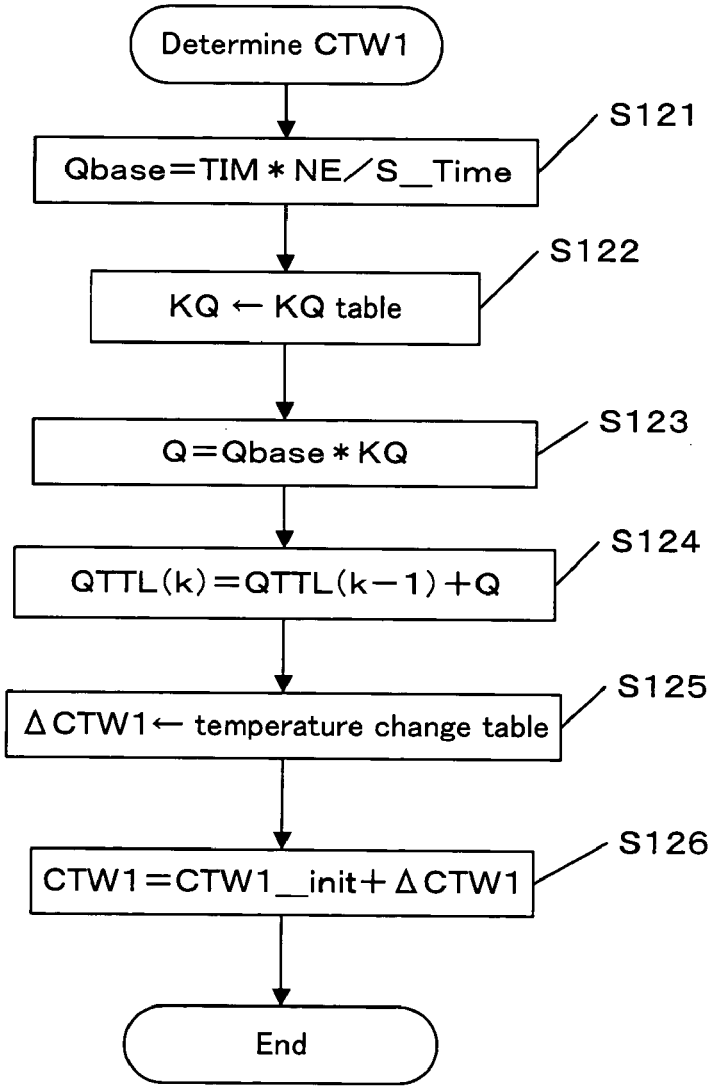
FIG. 19 shows a flowchart of a process for determining a first estimated engine water temperature in accordance with a fourth embodiment of the present invention.

FIG. 19 shows a flowchart of a process for determining the first estimated value CTW1. In step S121, a reference heat amount Qbase of the engine is calculated. The reference heat amount can be approximated by a fuel injection amount per unit time. The fuel injection amount per unit time is calculated by "a reference fuel injection amount TIM×the number of times of the fuel injection per unit time". The reference fuel injection amount TIM represents the amount of fuel that is injected at a time by the fuel injection valve, and is typically determined based on the engine rotational speed NE and the intake manifold pressure PB. The number of times of the fuel injection per unit time can be calculated based on the engine rotational speed NE. A unit time may be set to any appropriate value (for example, 1 TDC cycle or the like).

As an example, a unit time is set to be the same as the time interval at which the process of FIG. 19 is performed. Assuming that the time interval is represented by S_Time, the heat amount can be approximated by the equation "the reference fuel injection amount TIM×the rotational speed NE/S_time".

Figure 20:
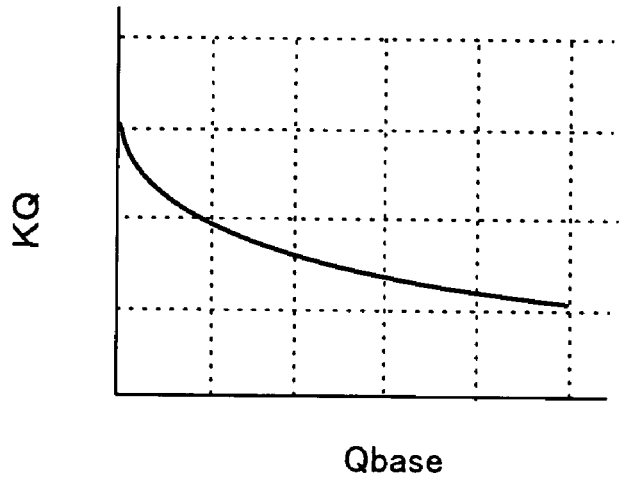
FIG. 20 shows a table for storing a correction coefficient KQ corresponding to a reference heat amount Qbase in accordance with a fourth embodiment of the present invention.

In step S122, the process refers to a table based on the reference heat amount Qbase to determine a correction coefficient KQ. Such a table may be pre-stored in the memory. FIG. 20 shows an example of the table. Alternatively, the table may be established so that the correction coefficient KQ is determined based on the intake manifold pressure Pb.

In step S123, the reference heat amount Qbase is multiplied by the correction coefficient KQ to calculate the heat amount Q for the current cycle. Since the engine water temperature in the case where the cooling loss is minimum (that is, zero) is estimated, the cooling loss is not calculated.

In step S124, the heat amount Q calculated in step S123 is added to the accumulated heat amount QTTL(k-1) that is determined in the previous cycle. In step S125, the process refers to a table based on the accumulated heat amount QTTL(k) determined in step S124 to determine the amount of change ΔCTW1.

Figure 21:
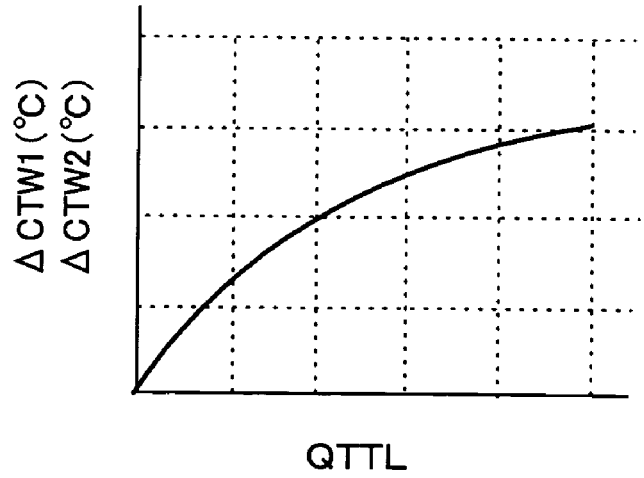
FIG. 21 shows a table for storing an amount of change in temperature corresponding to a heat amount QTTL in accordance with a fourth embodiment of the present invention.

Such a table for determining the amount of change ΔCTW1 may be pre-stored in the memory. FIG. 21 shows an example of the table. The table specifies the amount of change in the temperature corresponding to the heat amount. In step S126, the amount of change ΔCTW1 is added to an initial value CTW1_init (for example, TW_init is set in CTW1_init) to calculate the first estimated value CTW1.

Figure 22:
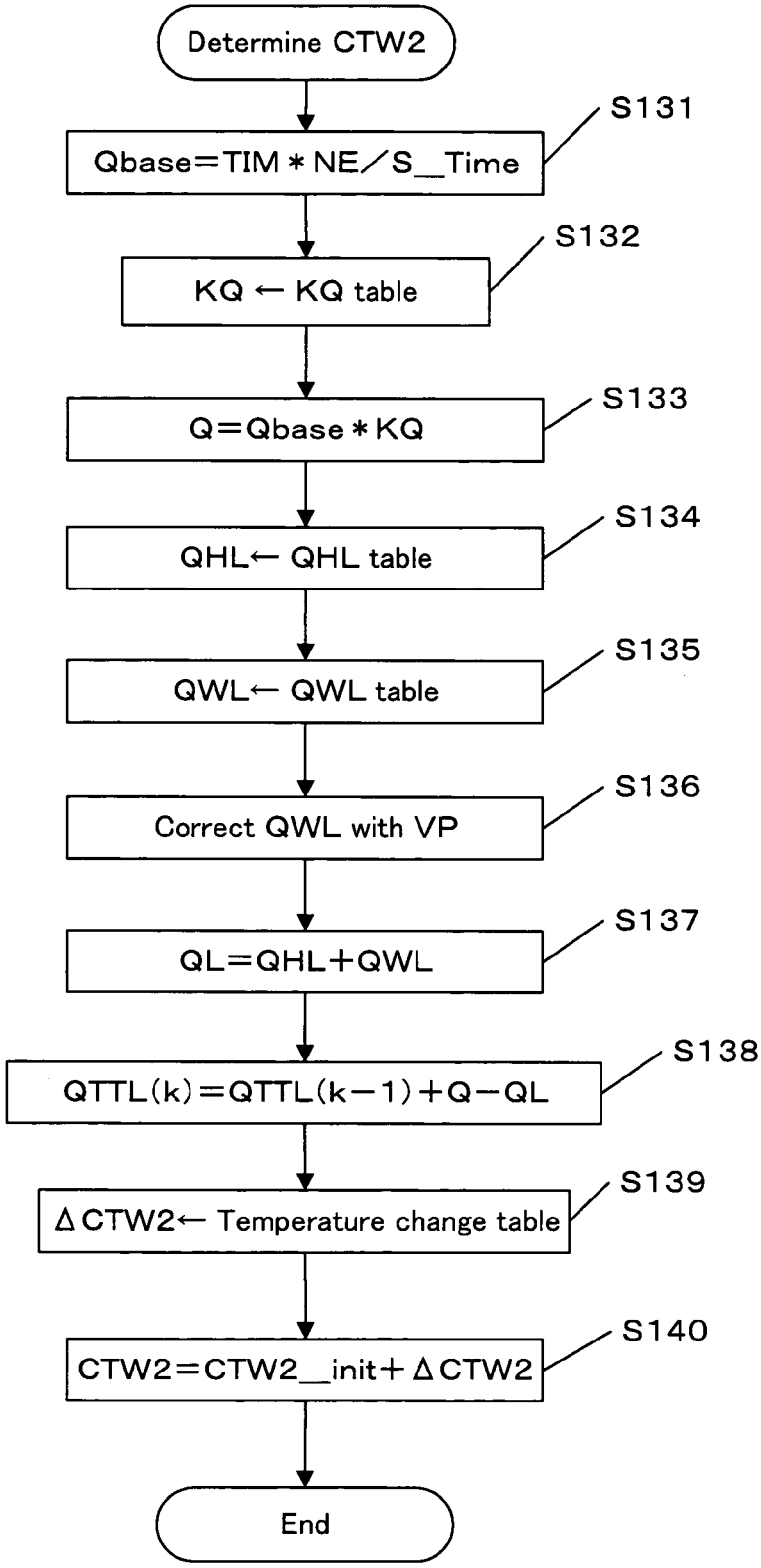
FIG. 22 shows a flowchart of a process for determining a second estimated engine water temperature in accordance with a fourth embodiment of the present invention.

FIG. 22 shows a flowchart of a process for determining the second estimated value CTW2. Steps S131 through S133 are the same as steps S121 through S123 of FIG. 19.

Figure 23:
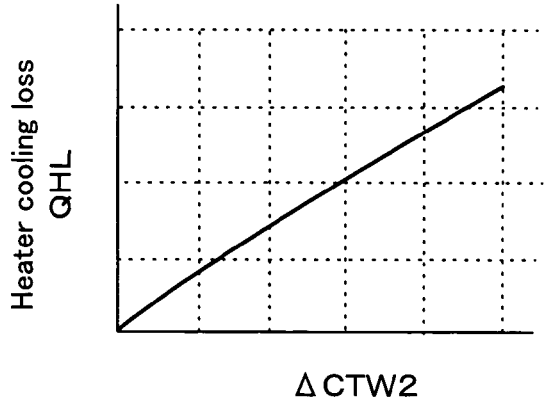
FIG. 23 shows a table for storing a heater cooling loss QHL corresponding to an amount of change in temperature in accordance with a fourth embodiment of the present invention.

In step S134, the heater cooling loss QHL is determined by referring to a table based on the amount of change ΔCTW2 determined in the previous cycle. Such a table may be pre-stored in the memory. FIG. 23 shows an example of the table. As the amount of change ΔCTW2 increases, the heater cooling loss QHL increases.

Figure 24:
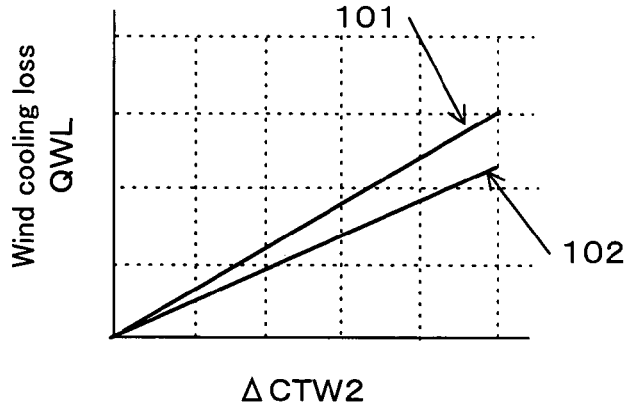
FIG. 24 shows a table for storing a wind cooling loss QWL corresponding to amount of change in temperature in accordance with a fourth embodiment of the present invention.

In step S135, the wind cooling loss QWL is determined by referring to a table based on the amount of change ΔCTW2 determined in the previous cycle. Such a table may be pre-stored in the memory. FIG. 24 shows an example of the table. A line 101 is for a case where the vehicle speed is 140 km/h and a line 102 is for a case where the vehicle speed is 100 km/h. The table is established so that the wind cooling loss QWL increases as the amount of change ΔCTW2 increases.

Figure 25:
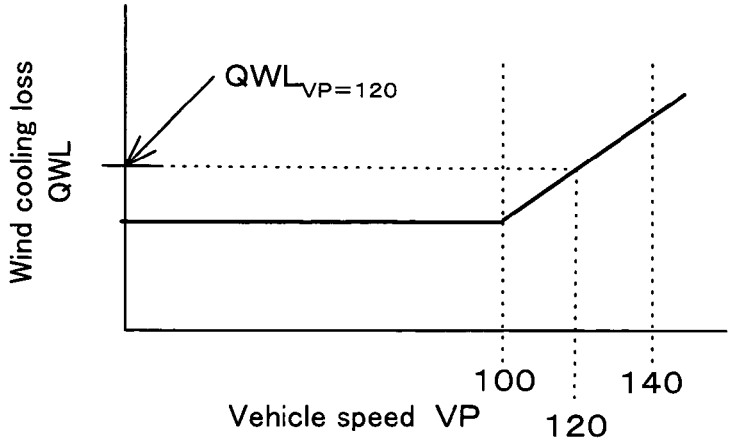
FIG. 25 schematically shows a relationship between a vehicle speed and a wind cooling loss QWL in accordance with a fourth embodiment of the present invention.

In step S136, the wind cooling loss determined in step S135 is corrected with the vehicle speed VP. For example, there is a relationship between the wind cooling loss and the vehicle speed as shown in FIG. 25. As an example, when the detected vehicle speed VP is 120 km/h, the wind cooling loss corresponding to the vehicle speed of 120 km/h can be determined as $QWL_{vp=120}$ by linearly interpolating the wind cooling loss corresponding to the vehicle speed of 100 km/h and the wind cooling loss corresponding to the vehicle speed of 140 km/h.

In step S137, the heater cooling loss QHL and the wind cooling loss QWL are summed up to determine the cooling loss QL. In step S138, the cooling loss QL is subtracted from a value obtained by adding the heat amount Q for the current cycle to the accumulated heat amount QTTL (k-1) calculated in the previous cycle, to determine the accumulated heat amount QTTL (k) for the current cycle.

In step S139, the amount of change ΔCTW2 is determined by referring to the table as shown in FIG. 21 based on the accumulated heat amount QTTL(k). In step S140, the amount of change ΔCTW2 is added to the initial value CTW2_init (for example, TW_init is set in CTW2_init) to determine the second estimated value CTW2.

Alternatively, any other method may be used to determine the first and the second estimated values CTW1 and CTW2.

An estimated value CTW for the current engine water temperature may be determined according to any appropriate method. Such an estimated value CTW may be used to perform the process shown in FIG. 18.

Figure 26:
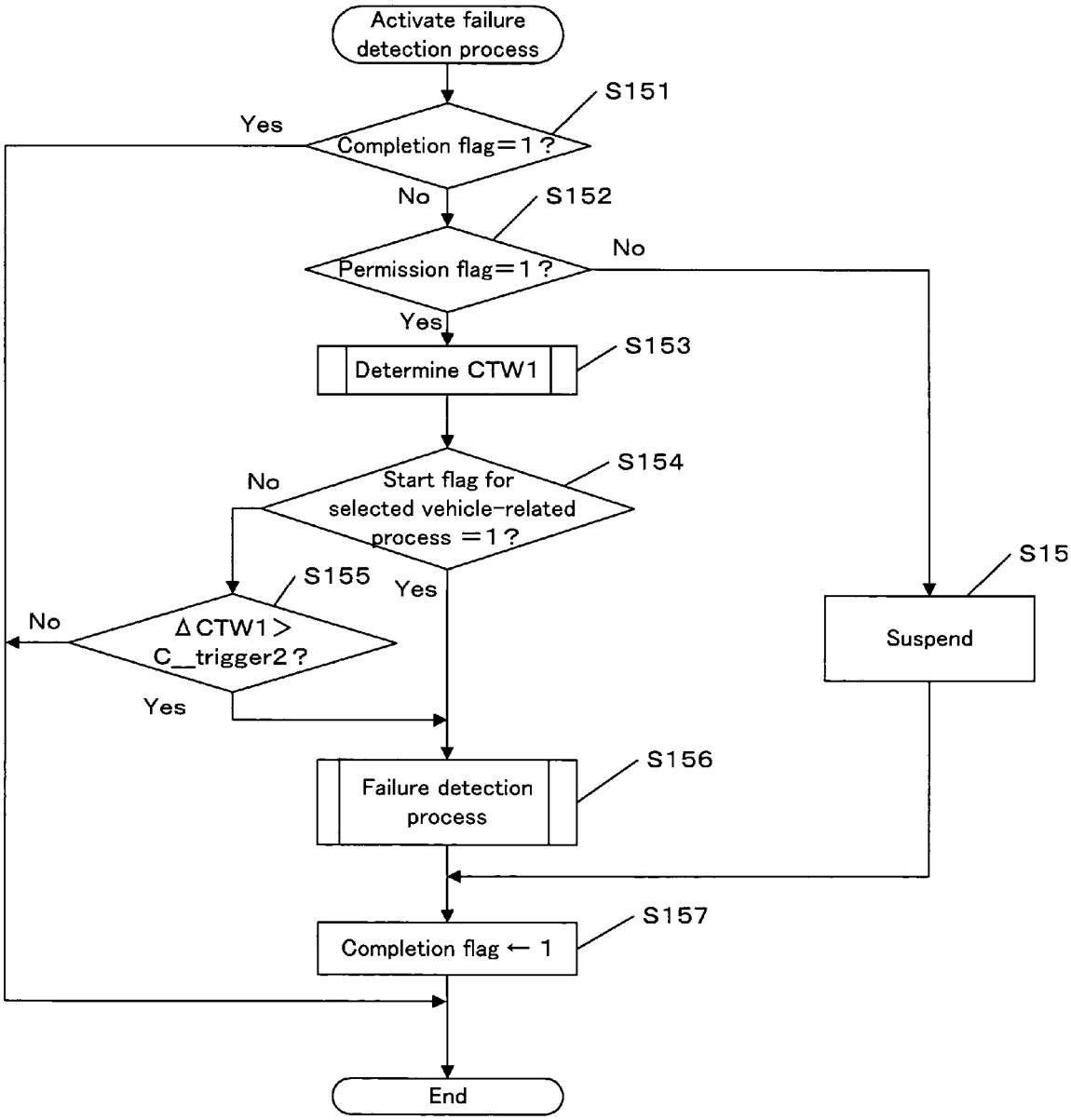
FIG. 26 shows a flowchart of a process for activating a thermostat failure detection process in accordance with a combination of the second and fourth embodiments of the present invention.

Some of the above-described first through fourth embodiments may be combined to detect a failure of the thermostat. As an example, FIG. 26 shows one embodiment where the second embodiment is combined with the fourth embodiment. In this embodiment, even if the start flag for the selected vehicle-related process is not set (S154), the thermostat failure detection process is activated (S156) when the amount of change ΔCTW1 in the first estimated value has exceeded the trigger value C_trigger2 (S155). According to this embodiment, the thermostat failure detection process can be performed even when the selected vehicle-related process cannot be carried out for some reason. Thus, the frequency of performing the thermostat failure detection process can be increased.

Figure 27:
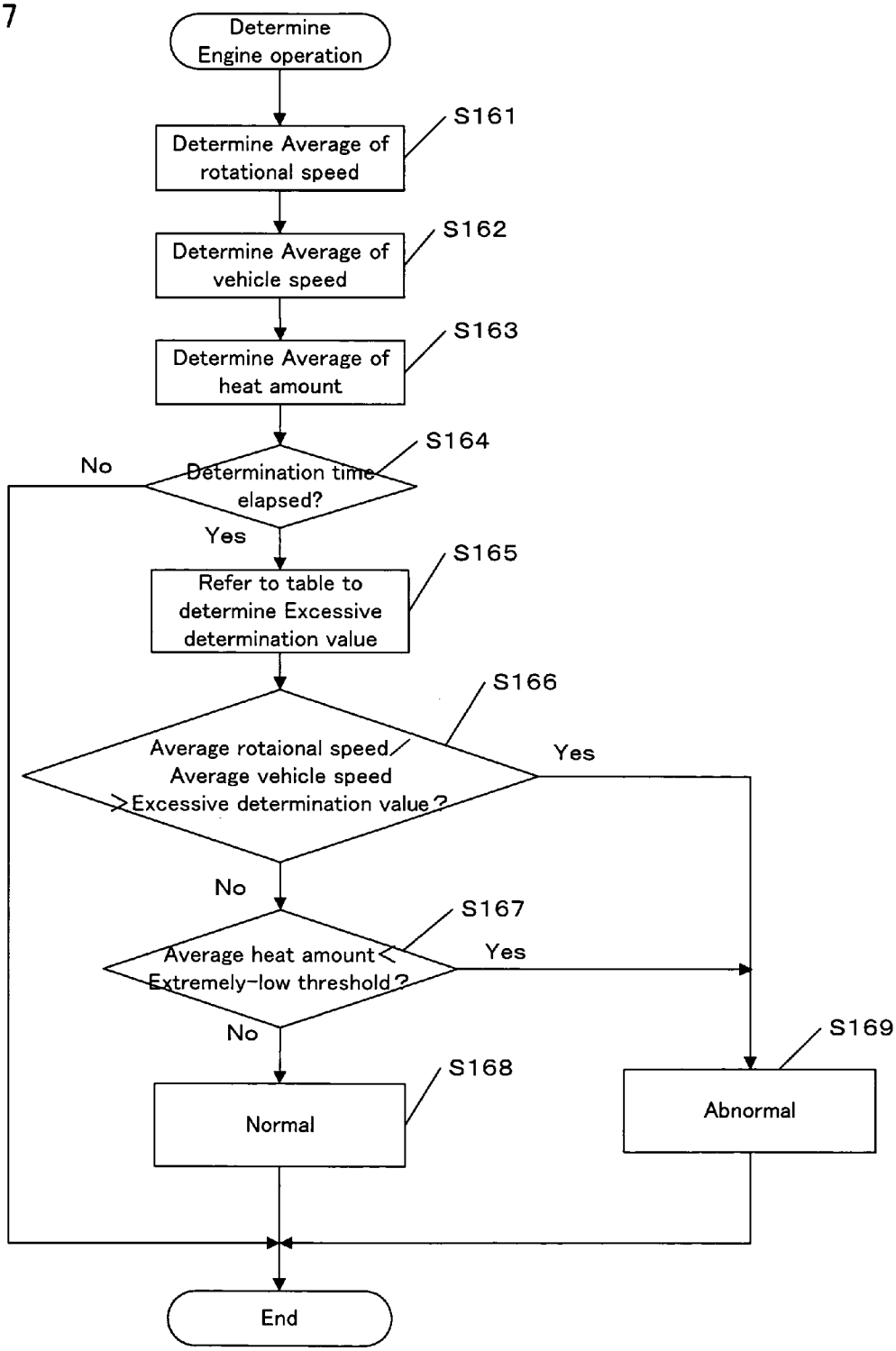
FIG. 27 shows a flowchart of a process for determining a normal operating condition of an engine in accordance with one embodiment of the present invention.

FIG. 27 is a flowchart of a process for determining whether the engine operation is normal. This process may be applied to any of the above-described embodiments. In the process, it is determined whether the engine is in a condition where a failure of the thermostat may be erroneously detected. It is preferable to perform the above-described process for activating the thermostat failure detection process (FIG. 6, FIG. 10, FIG. 13, FIG. 16, FIG. 17, FIG. 18 and FIG. 26) when it is determined that the engine operation is normal. In the above-described process for activating the thermostat failure detection process, a process as shown in FIG. 27 may be performed after the step for determining whether the permission flag has been set.

In step S161, an average of the rotational speed of the engine is calculated. In step S162, an average of the vehicle speed is calculated. In step S163, an average of the amount of heat generation of the engine is calculated. As described above, the amount of heat generation of the engine can be approximated by the equation "the reference fuel injection amount TIM×the rotational speed NE/S_time". S_time is the time interval at which the process of FIG. 27 is performed.

In step S164, it is determined whether a predetermined determination time has elapsed. The determination time is set to a time required for the engine rotational speed NE to become stable at a level (for example, 650 rpm) or more.

Figure 28:
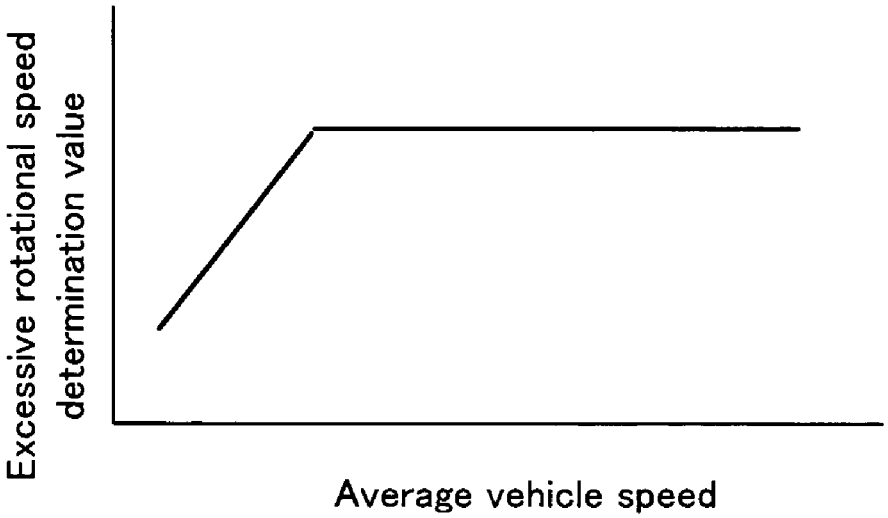
FIG. 28 shows a table for storing an excessive rotational speed determination value in accordance with one embodiment of the present invention.

In step S165, the process refers to a rotational speed table, which may be pre-stored in the memory, based on the vehicle speed to determine an excessive rotational speed determination value. FIG. 28 shows an example of such a table. The excessive rotational speed determination value is set to be low when the engine is idling and the vehicle speed is low. If the engine rotational speed is excessively high, the thermostat may open regardless of the engine water temperature. Accordingly, when the vehicle speed is high, the excessive rotational speed determination value is set to a rotational speed at which the thermostat may open unexpectedly.

If a value obtained by dividing the average of the rotational speed by the average of the vehicle speed is greater than the excessive rotational speed determination value (S166), it is determined that the engine operation is abnormal (S169). The condition where the decision of step S166 is Yes indicates, for example, a condition where there is no wind cooling loss (for example, when the vehicle is stopped) and the engine rotational speed is high. Under such a condition, a failure of the thermostat may not be detected accurately because a speed that the cooling water on the radiator side rises may be large. Further, in the condition where the excessive rotational speed determination value is exceeded, the thermostat may open due to a higher rotational speed of the engine. Since it is not preferable to perform the thermostat failure detection process when the thermostat is open, it is determined that the engine operation is abnormal.

In step S167, when the average of heat amount calculated in step S163 is lower than an extremely-low load threshold, it is determined that the engine operation is abnormal. The extremely-low load threshold is set to a value corresponding to the average of heat amount when the engine is idling. For example, when the vehicle is running the downhill, the engine load is very low and a time period during which fuel cut is performed may be long. In such a condition, the average of heat amount may become lower than the extremely-low load threshold. Since a failure of the thermostat may not be detected accurately when the heat amount is too low, it is determined that the engine operation is abnormal.

If it is determined that the engine operation is abnormal, the thermostat failure detection process is not carried out. If the decisions of steps S166 and S167 are No, it is determined that the engine operation is normal.

The invention may be applied to an engine to be used in a vessel-propelling machine such as an outboard motor in which a crankshaft is disposed in the perpendicular direction.

What is claimed is:

1. An apparatus for detecting a failure of a thermostat provided between an engine and a radiator, the thermostat regulating circulation of cooling water between the engine and the radiator, the apparatus comprising:

a first temperature sensor provided on a radiator side relative to the thermostat;

a second temperature sensor provided on an engine side relative to the thermostat; and a controller configured to:

determine that the engine has reached a desired warm condition if a temperature detected by the second temperature sensor reaches a first predetermined value;

perform a failure detection process if it is determined that the engine has reached the desired warm condition, the process detecting a failure of the thermostat based on an amount of change in a temperature detected by the first temperature sensor, without using a temperature detected by the second temperature sensor; and determine that the engine has reached the desired warm condition if an amount of change in the temperature detected by the second temperature sensor exceeds a second predetermined value before the temperature detected by the second temperature sensor reaches the first predetermined value.

2. A method for detecting a failure of a thermostat provided between an engine and a radiator, the thermostat regulating circulation of cooling water between the engine and the radiator, the method comprising the steps of:

detecting a first temperature of the cooling water in a radiator side relative to the thermostat;

detecting a second temperature of the cooling water in an engine side relative to the thermostat;

determining that the engine has reached a desired warm condition if the second temperature reaches a first predetermined value;

performing a failure detection process if it is determined that the engine has reached the desired warm condition, the process detecting a failure of the thermostat based on an amount of change in the first temperature without using the second temperature; and determining that the engine has reached the desired warm condition if an amount of change in the second temperature exceeds a second predetermined value before the second temperature reaches the first predetermined value.

3. An apparatus for detecting a failure of a thermostat provided between an engine and a radiator, the thermostat regulating circulation of cooling water between the engine and the radiator, the apparatus comprising:

means for detecting a first temperature of the cooling water in a radiator side relative to the thermostat;

means for detecting a second temperature of the cooling water in an engine side relative to the thermostat;

means for determining that the engine has reached a desired warm condition if the second temperature reaches a first predetermined value;

means for performing a failure detection process if it is determined that the engine has reached the desired warm condition, the process detecting a failure of the thermostat based on an amount of change in the first temperature, without using the second temperature; and means for determining that the engine has reached the desired warm condition if an amount of change in the second temperature exceeds a second predetermined value before the second temperature reaches the first predetermined value.

* * * * *